US011008809B2

(12) United States Patent
von Gynz-Rekowski et al.

(10) Patent No.: US 11,008,809 B2
(45) Date of Patent: May 18, 2021

(54) BENT HOUSING DRILLING MOTOR WITH COUNTER-ROTATING LOWER END

(71) Applicant: RIVAL DOWNHOLE TOOLS LC, Houston, TX (US)

(72) Inventors: Gunther H H von Gynz-Rekowski, Montgomery, TX (US); William Christian Herben, Magnolia, TX (US); Mark Allen Reeves, The Woodlands, TX (US); Donald M. Sawyer, Montgomery, TX (US); Roger W. Fincher, Conroe, TX (US)

(73) Assignee: Rival Downhole Tools, LC, Houston, TX (US)

( * ) Notice: Subject to any disclaimer, the term of this patent is extended or adjusted under 35 U.S.C. 154(b) by 82 days.

(21) Appl. No.: 16/261,094

(22) Filed: Jan. 29, 2019

(65) Prior Publication Data

US 2020/0240212 A1 Jul. 30, 2020

(51) Int. Cl.

| | |
|---|---|
| ***E21B 4/02*** | (2006.01) |
| ***E21B 7/06*** | (2006.01) |
| ***E21B 3/00*** | (2006.01) |
| ***E21B 44/00*** | (2006.01) |
| ***E21B 21/08*** | (2006.01) |

(52) U.S. Cl.

CPC ..... *E21B 4/02* (2013.01); *E21B 3/00* (2013.01); *E21B 7/06* (2013.01); *E21B 7/068* (2013.01); *E21B 21/08* (2013.01); *E21B 44/005* (2013.01)

(58) Field of Classification Search

CPC ..... E21B 4/02; E21B 4/04; E21B 7/067

See application file for complete search history.

(56) References Cited

U.S. PATENT DOCUMENTS

| | | | | |
|---|---|---|---|---|
| 6,059,050 | A * | 5/2000 | Gray | E21B 7/068 175/73 |
| 6,978,850 | B2 | 12/2005 | Sawyer | |
| 8,151,907 | B2 | 4/2012 | MacDonald | |
| 9,206,647 | B2 | 12/2015 | Prill et al. | |
| 9,388,636 | B2 * | 7/2016 | Winslow | E21B 7/067 |
| 9,797,197 | B1 | 10/2017 | Eddy | |
| 9,822,587 | B2 | 11/2017 | Prill et al. | |

(Continued)

OTHER PUBLICATIONS

Counter-Rotating Tandem Motor Drilling System Final Report, Jul. 30, 2009, prepared for U.S. Department of Energy.

*Primary Examiner* — Robert E Fuller

(74) *Attorney, Agent, or Firm* — McAughan Deaver PLLC

(57) ABSTRACT

A drilling assembly includes a power section with a housing that rotates in a first direction at a drill string rotation rate. An output rotates a drill bit through a transmission shaft in the first direction at a rotor rotation rate relative to the housing. A bent housing between the power section and the drill bit rotates in a second direction at a variable rotation rate relative to the power housing. The transmission shaft extends through the bent housing. A mechanical brake system adjusts the bent housing's variable rotation rate. The bent housing rotates relative to the wellbore in a rotary mode, but not in a sliding mode. The sliding mode maintains the drill bit's direction and inclination while the drill string rotates. In all modes, the drill bit's rotation rate is the sum of the drill string rate and the rotor rate relative to the power housing.

26 Claims, 28 Drawing Sheets

(56) References Cited

U.S. PATENT DOCUMENTS

| | | | | |
|---|---|---|---|---|
| 2005/0023037 | A1* | 2/2005 | Camp | E21B 7/067<br>175/61 |
| 2011/0284292 | A1* | 11/2011 | Gibb | E21B 7/06<br>175/61 |
| 2012/0018218 | A1* | 1/2012 | Rosenhauch | E21B 7/04<br>175/24 |
| 2012/0031676 | A1* | 2/2012 | Comeau | E21B 4/16<br>175/61 |
| 2016/0024848 | A1* | 1/2016 | Desmette | E21B 7/067<br>175/74 |

* cited by examiner

BENT HOUSING DRILLING MOTOR WITH COUNTER-ROTATING LOWER END

BACKGROUND

Directional drilling of oil and gas wells is typically completed using either bent drilling motors with measurement-while-drilling (MWD) components or rotary steerable systems. Both tools have disadvantages. The bent drilling motors reduce the rate of penetration in a sliding mode because the drill string may not be rotated while a tool face is adjusted. The rotary steerable systems involve significantly higher costs.

DETAILED DESCRIPTION OF THE PREFERRED EMBODIMENTS

A bore hole drilling assembly is configured for attachment to a lower end of a drill string for drilling a wellbore through a subterranean formation. The drilling assembly is configured for directional drilling with drill bit direction and inclination adjustments while the drill string rotates. The drilling assembly automatically adjusts an operating mode in response to adjustments in a rotation rate of the drill string. The drilling assembly is configured to allow the drill string to rotate in all operating modes. The drilling assembly also automatically adjusts a tool face orientation of its drill bit in response to specific adjustments in the rotation rate of the drill string. In one embodiment, the tool face orientation of the drill bit is automatically adjusted in increments.

The bore hole drilling assembly may include a power section, a drill bit, a bent housing disposed between the power section and the drill bit, a mechanical brake system, and an electronics section. The power section is configured to rotate a power section output and the drill bit relative to a power section housing. The bent housing is configured to provide an adjustment in the path of the wellbore produced by the drilling assembly. The mechanical brake system adjusts a rotation rate of the bent housing. The electronics section is configured to sense at least a rotation rate of the drill string and to adjust the operating mode based on the detected rotation rate. The bent housing is configured to rotate in a direction that is opposite to the direction of rotation of the drill string and a power section housing. The bent housing rotates relative to the surrounding formation in a rotary mode, but does not rotate relative to the surrounding formation in the sliding mode. In all modes, a rotation rate of the drill bit in the first direction relative to a wellbore is the sum of a rotation rate of the power section housing and a rotation rate of the power section output relative to the power section housing. The drilling assembly may be used in curved, tangent, and horizontal sections of a wellbore.

Figure 1:
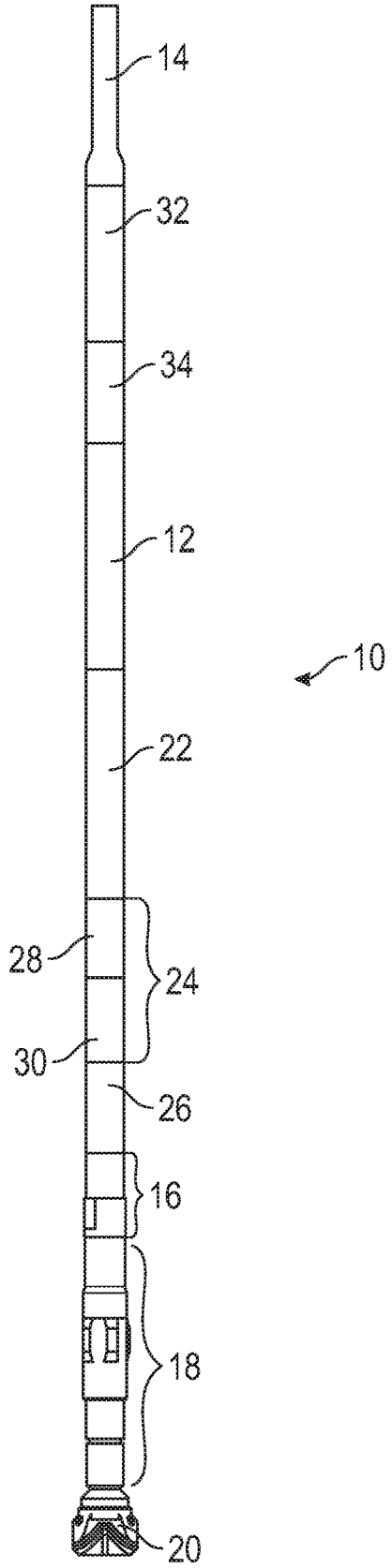
FIG. 1 is a side view of one embodiment of a drilling assembly disclosed herein.

FIG. 1 illustrates one embodiment of the bore hole drilling assembly. Drilling assembly 10 includes power section 12 disposed below drill string 14. Bent housing 16 and bearing section 18 are disposed between power section 12 and drill bit 20. Orienting section 22, swivel 24, and electronics section 26 may be disposed between power section 12 and drill bit 20. Swivel 24 may include swivel housing 28 and swivel mandrel 30 below swivel housing 28. Drilling assembly 10 may further include MWD section 32 (i.e., measurement-while-drilling sub) and receiver sub 34. The receiver sub 34 is configured to receive a signal from electronics section 26 and to transmit the signal to the MWD section 32. The signal may be an electromagnetic signal or transmitted throughout a mechanical slip ring arrangement. As explained in more detail below, rotation of drill string 14 in a first direction rotates MWD sub 32, receiver sub 34, a housing of power section 12, a housing of orienting section 22, and swivel housing 28 in the first direction at the same rotation rate. Orienting section 22 rotates swivel mandrel 30, electronics section 26, bent housing 16, and bearing section 18 in a second direction. In one embodiment, the second direction is the opposite direction of the first direction.

Figure 2:
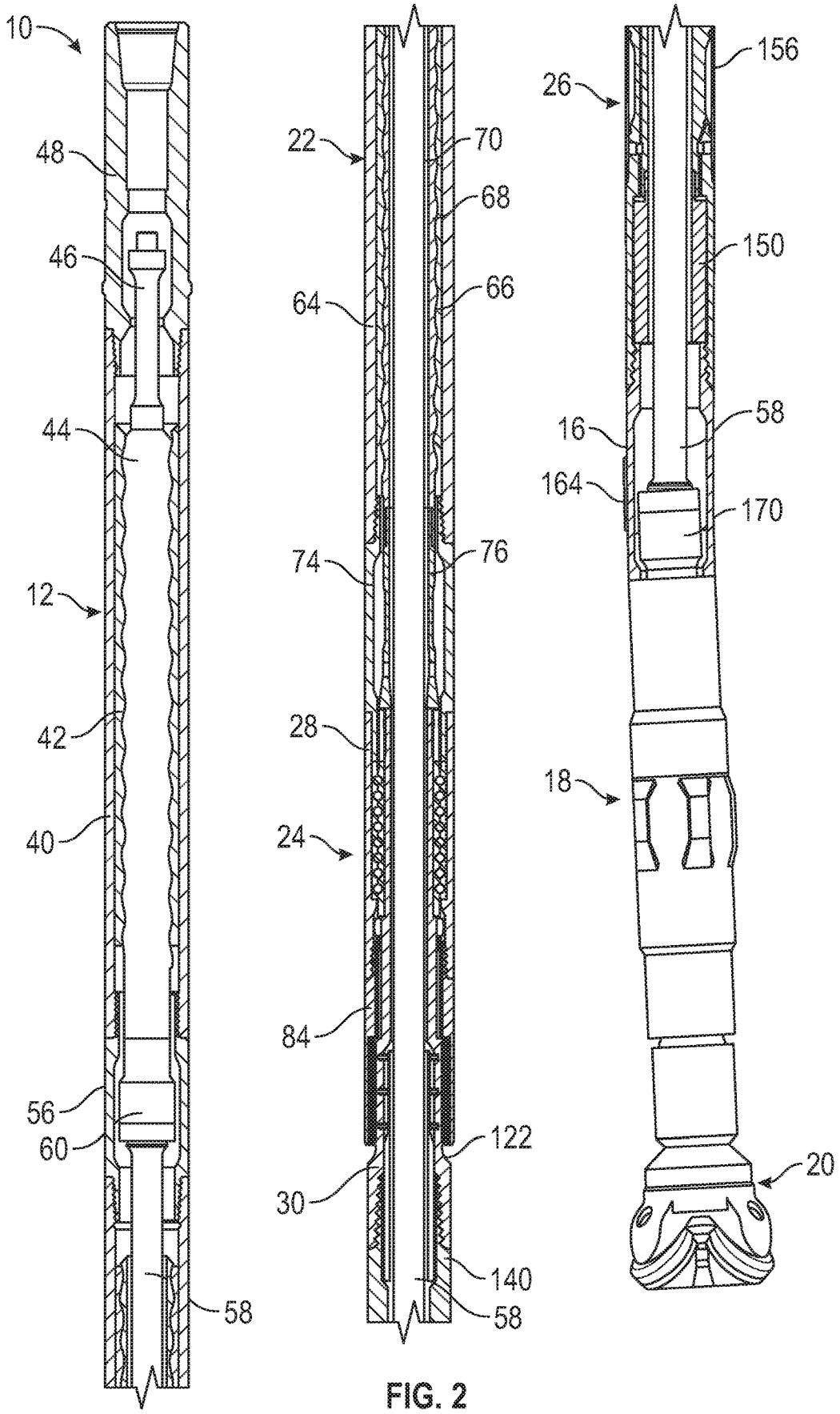
FIG. 2 is a cross-sectional view of the drilling assembly shown in FIG. 1.
Figure 3A:
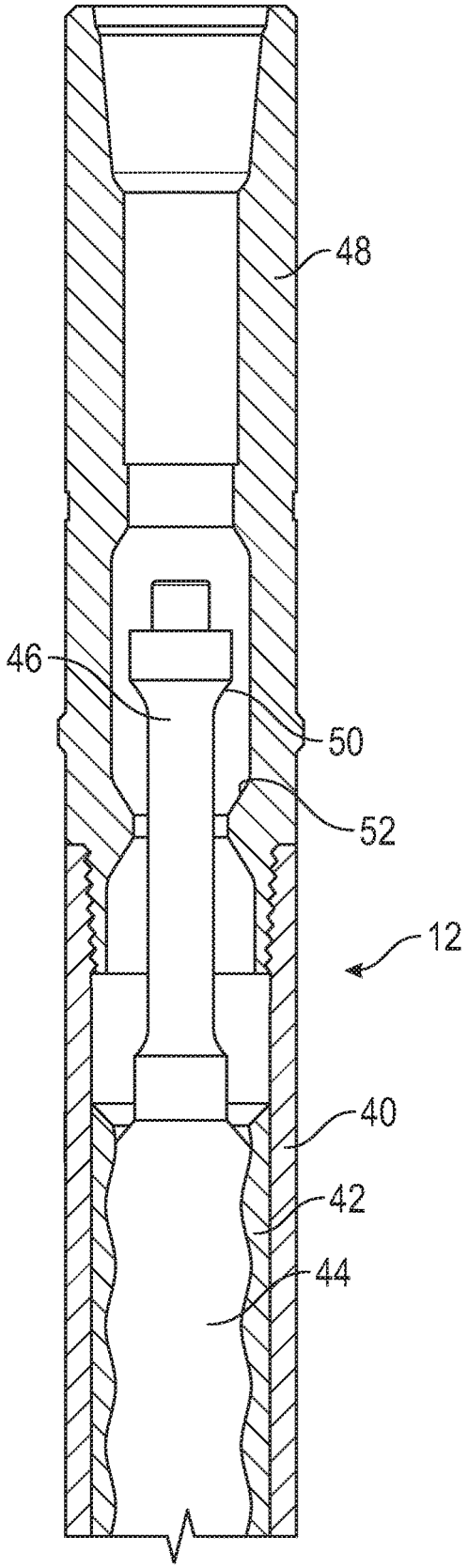
FIGS. 3A-3F are sequential cross-sectional views of the drilling assembly shown in FIG. 1.
Figure 3B:
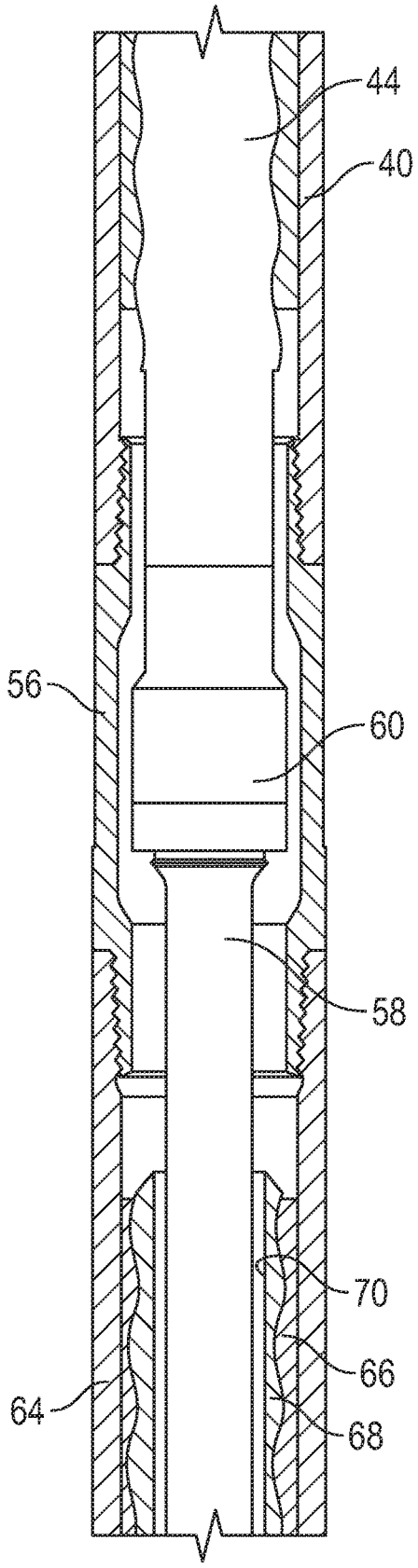

With reference to FIGS. 2 and 3A-3B, power section 12 includes power section housing 40 with stator 42 secured to an inner wall of power section housing 40 and with rotor 44 disposed within a central bore of stator 42. As readily understood by skilled artisans, a fluid flow through cavities formed between the outer surface profile of rotor 44 and the inner surface profile of stator 42 causes rotor 44 to rotate relative to stator 42 and power section housing 40. Power section 12 is configured to rotate rotor 44 in the same direction as the rotation of stator 42. In this way, power section 12 converts hydraulic horsepower from a drilling fluid into mechanical (rotational) horsepower to drive drill bit 20 with the power section output (rotor 44 in this embodiment). Catch 46 may be attached to an upper end of rotor 44 for any potential separation of housing connections below top sub 48. Catch 46 may include shoulder 50 designed to engage shoulder 52 within top sub 48 to retain catch 46 within top sub 48. Top sub 48 may be connected to drill string 14 through MWD section 32 and receiver sub 34. In this way, a rotation of drill string 14 in a first direction at a drill string rotation rate causes top sub 48, power section housing 40, and stator 42 to all rotate in the first direction at the drill string rotation rate. A fluid flow through power section 12 causes rotor 44 to rotate in the first direction at a rotor rotation rate relative to power section housing 40.

With reference to FIGS. 2 and 3B, crossover sub 56 may be secured below power section 12. A lower end of rotor 44 extends into the inner bore of crossover sub 56 where it is attached to transmission shaft 58 via connection 60. Transmission shaft 58 may be a continuous velocity joint (i.e., C-V joint), flex shaft, or any other connection shaft configured to transfer sufficient torque between rotor 44 and drill bit 20. Crossover sub 56 is a pin-by-pin sub configured to connect power section 12 to orienting section 22. Crossover sub 56 rotates in the first direction at the drill string rotation rate with power section housing 40. Transmission shaft 58 rotates in the first direction at the rotor rotation rate relative to crossover sub 56.

Figure 3C:
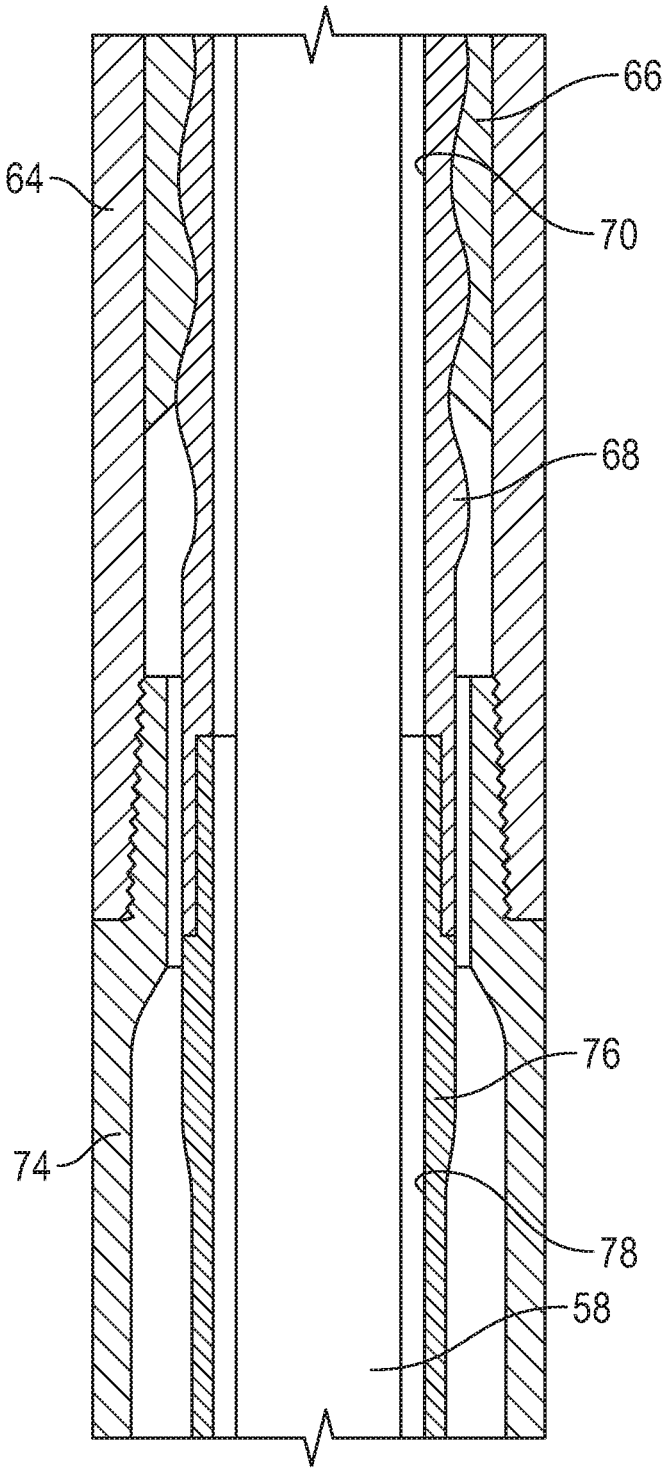

Referring now to FIGS. 2 and 3B-3C, orienting section 22 includes orienting housing 64 with orienting stator 66 secured to an inner wall of orienting housing 64. Orienting housing 64 is secured below crossover sub 56. Orienting rotor 68 is disposed within a central bore of orienting stator 66. Orienting rotor 68 includes central bore 70 dimensioned to house a portion of transmission shaft 58 therethrough. The upper end of orienting rotor 68 is not connected to another component and is open to fluid flow. As readily understood by skilled artisans, a fluid flow through cavities formed between the outer surface profile of orienting rotor 68 and the inner surface profile of orienting stator 66 causes orienting rotor 68 to rotate relative to orienting stator 66 and orienting housing 64. Orienting stator 66 is configured to rotate orienting rotor 68 in the opposite direction as the rotation of orienting section 22. In this way, orienting section 22 converts hydraulic horsepower from a drilling fluid into mechanical (rotational) horsepower to rotate orienting rotor 68 in the opposite direction from the rotation of orienting housing 64. Excess fluid bypasses through central bore 70 of orienting rotor 68 around transmission shaft 58. Orienting housing 64 and orienting stator 66 rotate in the first direction at the drill string rotation rate along with crossover sub 56 and power section housing 40. Transmission shaft 58 disposed through central bore 70 of orienting rotor 68 rotates in the first direction at the rotor rotation rate relative to orienting housing 64. Orienting rotor 68 rotates in a second direction at a variable rotation rate relative to orienting housing 64 and orienting stator 66.

Figure 3D:
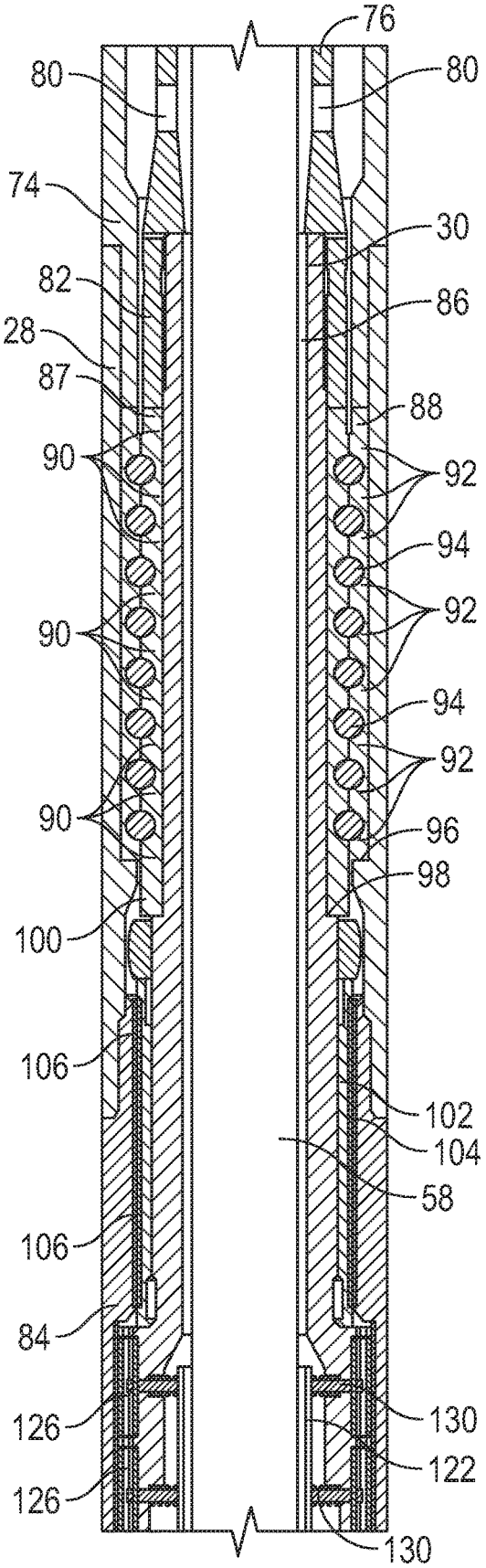
Figure 3E:
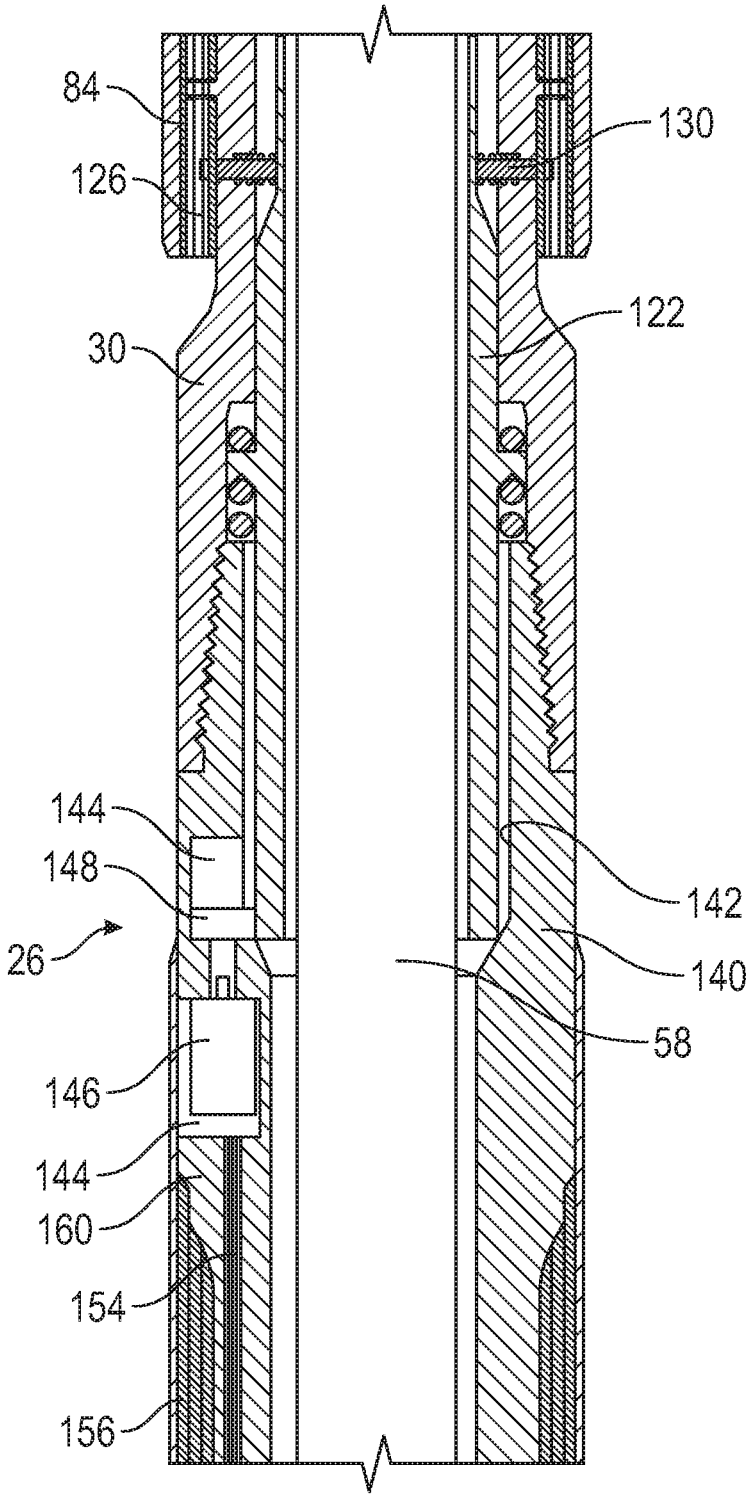

With reference to FIGS. 2 and 3C-3D, second crossover sub 74 may be secured below orienting housing 64. Flex shaft 76 may be disposed within crossover sub 74. An upper end of flex shaft 76 is secured to a lower end of orienting rotor 68. Flex shaft 76 includes central bore 78 and one or more fluid ports 80 extending from an outer surface to central bore 78. Transmission shaft 58 extends through central bore 78 of flex shaft 76. Fluid flowing exiting from the cavities between orienting stator 66 and orienting rotor 68 may flow through an annular space between second crossover sub 74 and flex shaft 76. This fluid may flow through fluid ports 80 and into central bore 78 of flex shaft 76. Second crossover sub 74 rotates in the first direction at the drill string rotation rate with orienting housing 64, crossover sub 56, and power section housing 40. Transmission shaft 58 rotates in the first direction at the rotor rotation rate relative to second crossover sub 74. Flex shaft 76 rotates with orienting rotor 68 in the second direction, opposite the first direction, at the variable rotation rate relative to the second crossover sub 74.

Referring now to FIGS. 2 and 3D, an upper end of swivel housing 28 may be secured to a lower end of second crossover sub 74 such that swivel housing 28 rotates with second crossover sub 74. Swivel nut 84 may be secured to a lower end of swivel housing 28. Swivel mandrel 30 is secured to lower end 82 of flex shaft 76 such that swivel mandrel 30 rotates with flex shaft 76. Swivel mandrel 30 includes central bore 86 dimensioned to allow transmission shaft 58 to extend therethrough. Swivel housing 28 and swivel nut 84 rotate in the first direction at the drill string rotation rate with second crossover sub 74, orienting housing 64, crossover sub 56, and power section housing 40. Transmission shaft 58 rotates in the first direction at the rotor rotation rate relative to swivel housing 28 and swivel nut 84. Swivel mandrel 30 rotates with flex shaft 76 and orienting rotor 68 in the second direction, opposite the first direction, at the variable rotation rate relative to swivel housing 28 and swivel nut 84.

An upper portion of swivel mandrel 30 is configured to accommodate bearings for the relative rotation between swivel mandrel 30 and swivel housing 28. Any combination of radial and thrust bearings may be disposed in an annular space between swivel housing 28 and swivel mandrel 30. In the illustrated embodiment, inner upper radial bearing 87 and outer upper radial bearing 88 are disposed between swivel housing 28 and swivel mandrel 30. Inner upper radial bearing 87 is disposed below lower end 82 of flex shaft 76, and rotates with flex shaft 76 and swivel mandrel 30 in the second direction at the variable rotation rate relative to swivel housing 28. Outer upper radial bearing 88 is disposed below a lower end of second crossover sub 74, and rotates with second crossover sub 74 and swivel housing 28 in the first direction at the drill string rotation rate. Inner upper radial bearing 87 engages outer upper radial bearing 88 to absorb any eccentric motion of the orienting section 22. A thrust bearing is disposed in the annular space between swivel mandrel 30 and swivel housing 28 to transmit weight on bit and overpull forces. The thrust bearing may be formed of inner thrust races 90, outer thrust races 92, and spherical members 94 disposed between inner and outer thrust bearings 90, 92 as illustrated. Inner thrust races 90 rotate with swivel mandrel 30 in the second direction at the variable rotation rate relative to swivel housing 28, while outer thrust races 92 rotate with swivel housing 28 in the first direction at the drill string rotation rate. Outer thrust races 92 may be supported in the annular space between swivel mandrel 30 and swivel housing 28 by internal shoulder 96 of swivel housing 28, while inner thrust races 90 may be supported in the annular space by external shoulder 98 of swivel mandrel 30. In one embodiment, spacer 100 is disposed between external shoulder 98 of swivel mandrel 30 and inner thrust bearings 90. Lower radial bearing 102 may be disposed in an annular space between swivel nut 84 and swivel mandrel 30 to absorb a bending moment and side loading between orienting section 22 and a lower end of drilling assembly 10. Lower radial bearing 102 rotates with swivel mandrel 30 in the second direction at the variable rotation rate relative to swivel housing 28. An outer surface of lower radial bearing 102 may include wear surface 104 formed of a hard facing material. An inner surface of swivel nut 84 may include one or more wear surfaces 106 formed of a hard facing material. Wear surface 104 of lower radial bearing 102 engages wear surfaces 106 of swivel nut 84 to provide the radial bearing function. In another embodiment, lower radial bearing 102 is disposed in an annular space between swivel mandrel 30 and swivel housing 28.

A middle portion of swivel mandrel 30 is configured to provide a mechanical brake system for adjusting the variable rotation rate of swivel mandrel 30. The mechanical brake system increases or decreases torque to control the variable rotation rate of swivel mandrel 30. As a load on orienting section 22 increases, the pressure drop across orienting section 22 also increases. The rise in pressure drop diverts more drilling fluid to flow through central bore 70 of orienting rotor 68, thereby reducing the fluid flow rate through orienting stator 66 and orienting rotor 68. The reduction in flow rate through orienting stator 66 and orienting rotor 68 reduces the rotational rate of orienting rotor 68. Conversely, a decrease in brake torque allows for an increase in the rotational rate of orienting rotor 68. Many brake designs are suitable for drilling assembly 10. For example, the mechanical brake system may include a drum brake, a disk brake, or a cone brake arrangement.

With reference now to the embodiment illustrated in FIGS. 2, 3D-3E, and 4, middle portion 110 of swivel mandrel 30 includes expanded central bore 112 and an expanded outer surface. The inner surface of middle portion 110 of swivel mandrel 30 includes inner recesses 114. The outer surface of middle portion 110 of swivel mandrel 30 includes outer recesses 116. Lower end 118 of swivel nut 84 includes an expanded inner bore having inner wear surface 120. Outer recesses 116 of swivel mandrel 30 are generally aligned with inner wear surface 120 of swivel nut 84. Brake actuator 122 is disposed at least partially within swivel mandrel 30 with actuating portion 123 of brake actuator 122 disposed within expanded central bore 112 of middle portion 110 of swivel mandrel 30. Transmission shaft 58 is disposed through central bore 124 of brake actuator 122.

A brake drum system is illustrated in FIGS. 3D-3E, 4, and 5. The brake drum system includes one or more brake pads. For example, the brake drum system may include brake pads 126 disposed within each of outer recesses 116 of swivel mandrel 30. Each brake pad 126 includes outer wear surface 128 designed to engage inner wear surface 120 of swivel nut 84. At least one brake shoe 130 is secured to each brake pad 126 such that brake pad 126 moves radially with brake shoe 130. In one embodiment, distal end 132 of each brake shoe 130 is secured to a brake pad 126 with brake shoe 130 extending through an aperture in swivel mandrel 30 from outer recess 116 to inner recess 114. Proximal end 134 of each brake shoe 130 may engage an outer surface of brake actuator 122. Each of springs 136 may engage one of inner recesses 114 to bias the attached brake shoe 130 radially inward toward brake actuator 122. Brake pads 126, brake shoes 130, and springs 136 all rotate with swivel mandrel 30 in the second direction at the variable rotation rate relative to swivel nut 84. Brake actuator 122 moves in a specified rotational direction relative to swivel mandrel 30 to a specified degree in response to a signal from electronics section 26 in order to apply a selected brake load between brake pads 126 and swivel nut 84, thereby adjusting a brake torque and thereby the variable rotation rate of swivel mandrel 30 relative to swivel nut 84.

Figure 5:
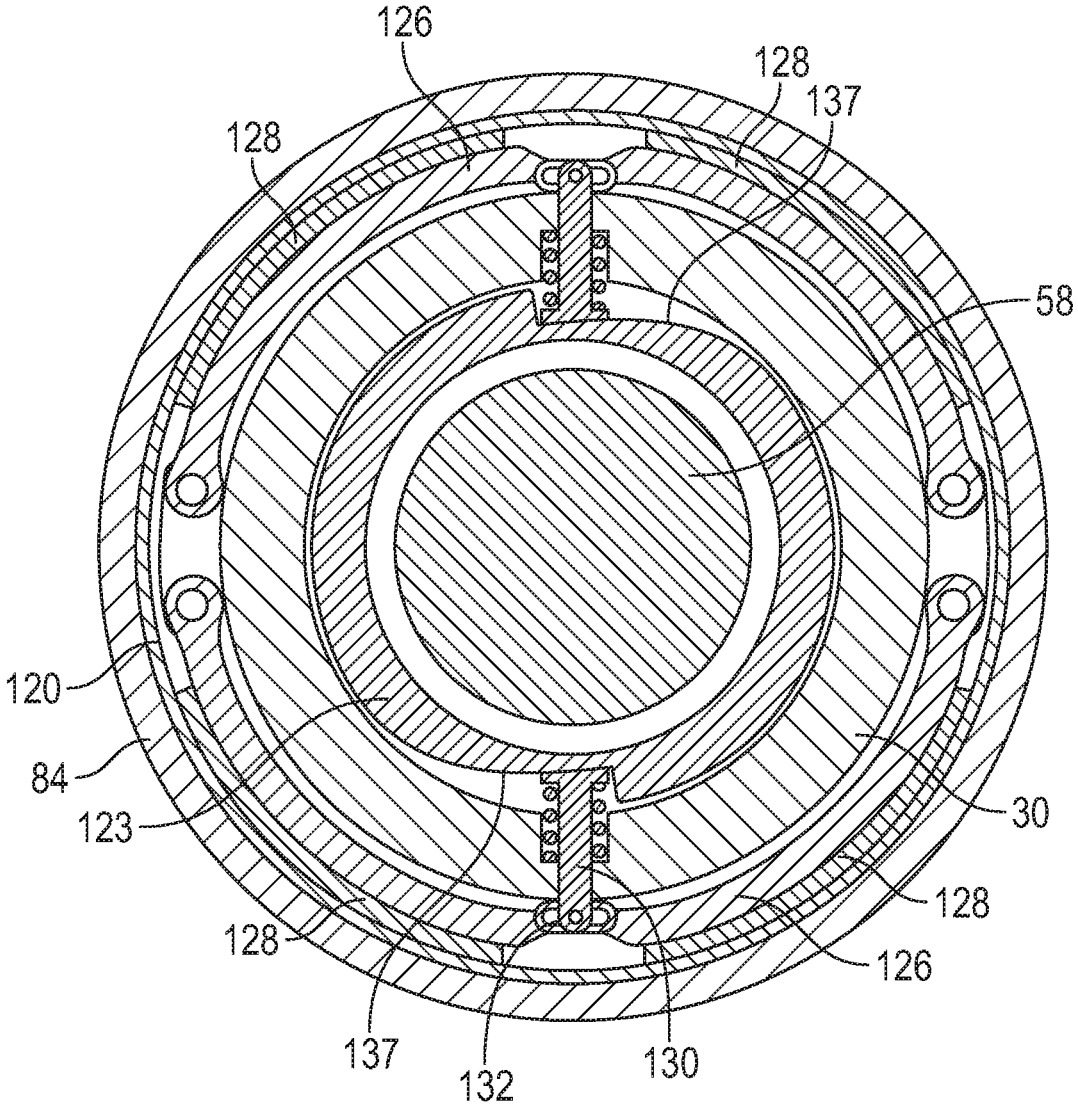
FIG. 5 is a cross-sectional view of the mechanical brake system taken along line A-A in FIG. 4, with the mechanical brake system in a default position.
Figure 6:
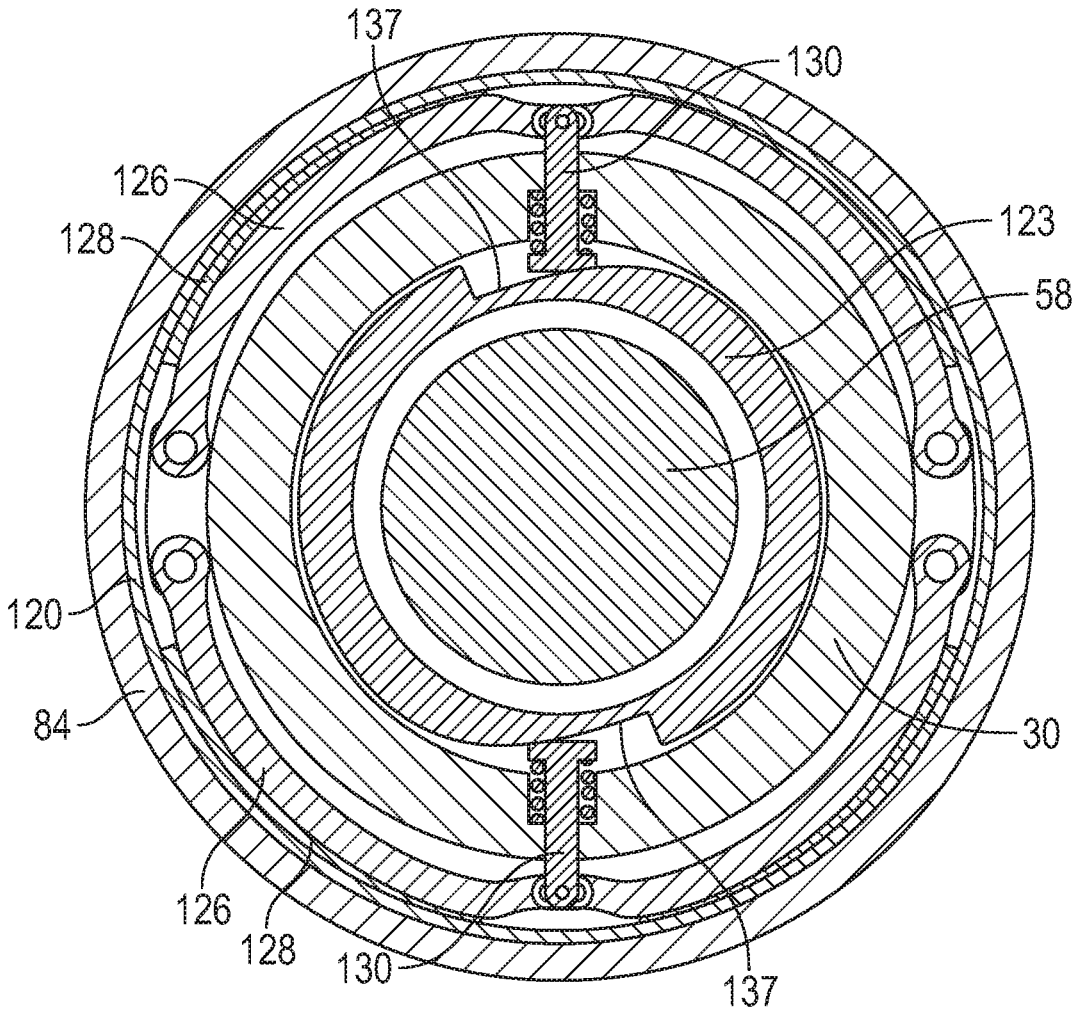
FIG. 6 is a cross-sectional view of the mechanical brake system taken along line A-A in FIG. 4, with the mechanical brake system in an actuated position.

FIGS. 5 and 6 illustrate one embodiment of actuating portion 123 of brake actuator 122. In this embodiment, the circumference of actuating portion 123 includes two cam surfaces 137. In other embodiments, the circumference of actuating portion 123 may include three or more cam surfaces. In a default position as illustrated in FIG. 5, proximal end 134 of each brake shoe 130 engages the outer surface of brake actuator 122 on a smaller diameter portion of cam surface 137. In an actuated position illustrated in FIG. 6, brake actuator 122 has been rotated such that proximal end 134 of each brake shoe 130 engages the outer surface of brake actuator 122 on a larger diameter portion of cam surface 137. In this actuated position, the increased diameter of brake actuator 122 pushes brake shoes 130 radially outward, thereby pushing brake pads 126 radially outward to compress wear surfaces 128 of brake pads 126 against wear surface 120 of swivel nut 84. In the actuated position, the mechanical brake system reduces the variable rotation rate of swivel mandrel 30 in the second direction relative to swivel housing 28 and swivel nut 84.

Referring again to FIGS. 2 and 3E-3F, a lower portion of swivel mandrel 30 and brake actuator 122 extend below swivel nut 84. The lower portion of swivel mandrel 30 extending below swivel nut 84 may include an expanded outer diameter as shown. The lower end of swivel mandrel 30 may be secured to an upper end of electronics housing 140 of electronics section 26. The lower end of brake actuator 122 extends at least partially into central bore 142 of electronics housing 140. Transmission shaft 58 also extends through central bore 142 of electronics housing 140. Electronics housing 140 also includes one or more cavities 144 between central bore 142 and its outer surface.

Electronics section 26 may also include motor 146 mechanically connected to gear 148. Motor 146 and gear 148 may be disposed within cavities 144. Gear 148 engages a lower end of brake actuator 122 to adjust a brake torque as explained in more detail below. Gear 148 may be a spur gear, a worm gear, or any other control mechanism capable of engaging the lower end of brake actuator 122. Cavity 144 may further house magnetic sensors, Hall Effect sensors, or other sensor technology to detect the differential speed and direction between swivel mandrel 30 relative to swivel housing 28 and swivel nut 84. Additional magnets or electronic activation mechanisms can be positioned in swivel nut 84 to amplify this effect. Electronics section 26 may further include control unit 150 disposed within central bore 142 of electronics housing 140. Control unit 150 may include electronic components, such as one or more processors, microprocessors, CPUs, electronic storage or memory devices, batteries (e.g., commercially available batteries such as size "D" or size "C" batteries), and/or sensors (e.g., sensors for gamma, inclination, tool face, pressure, temperature, WOB (weight-on-bit), torque, and relative rotation rate). The batteries may provide an independent power source for controlling the mechanical brake system, which is independent of drilling parameters such as WOB, pressure, fluid flow rate, and drill string rotation rate. Control unit 150 includes central bore 152 dimensioned to allow transmission shaft 58 to extend therethrough. Electronic connections 154 extend from control unit 150 to motor 146. In this way, gear 148 and motor 146 may be controlled by components in control unit 150. Electronic port 155 may extend from an outer surface of electronic housing 140 to electronic connections 154 to allow a user to upload data or instructions into or download data, analytics, or measurements from components within control unit 150. Electronics section 26 may further include antenna 156 disposed in an external recess of electronics housing 140. Electronic connections 158 extend from control unit 150 to antenna 156. In this way, antenna 156 may transmit data to receiver sub 34 above. Electronic port 159 may extend from an outer surface of electronic housing 140 to electronic connections 158 to allow a user to upload data or instructions into or download data, analytics, or measurements from components within control unit 150. Sleeve 160 may be disposed over electrical housing 140 to encase all elements of electrical section 26 that are externally exposed, such as cavities 144, antenna 156, and electrical ports 155 and 159. In this way, sleeve 160 protects the elements of electrical section 26. In one embodiment, sleeve 160 may be a short hop transmitter configured to send electromagnetic signals to a short hop receiver sub 34 adjacent to MWD section 32 above. The electromagnetic signals may include information about inclination, gamma, and tool face. Electrical housing 140 and control unit 150 rotate with swivel mandrel 30 in the second direction at the variable rotation rate in relation to swivel housing 28. Transmission shaft 58 rotates within central bore 142 of electrical housing 140 and within central bore 152 of control unit 150 in the first direction at the rotor rotation rate relative to swivel housing 28.

Figure 3F:
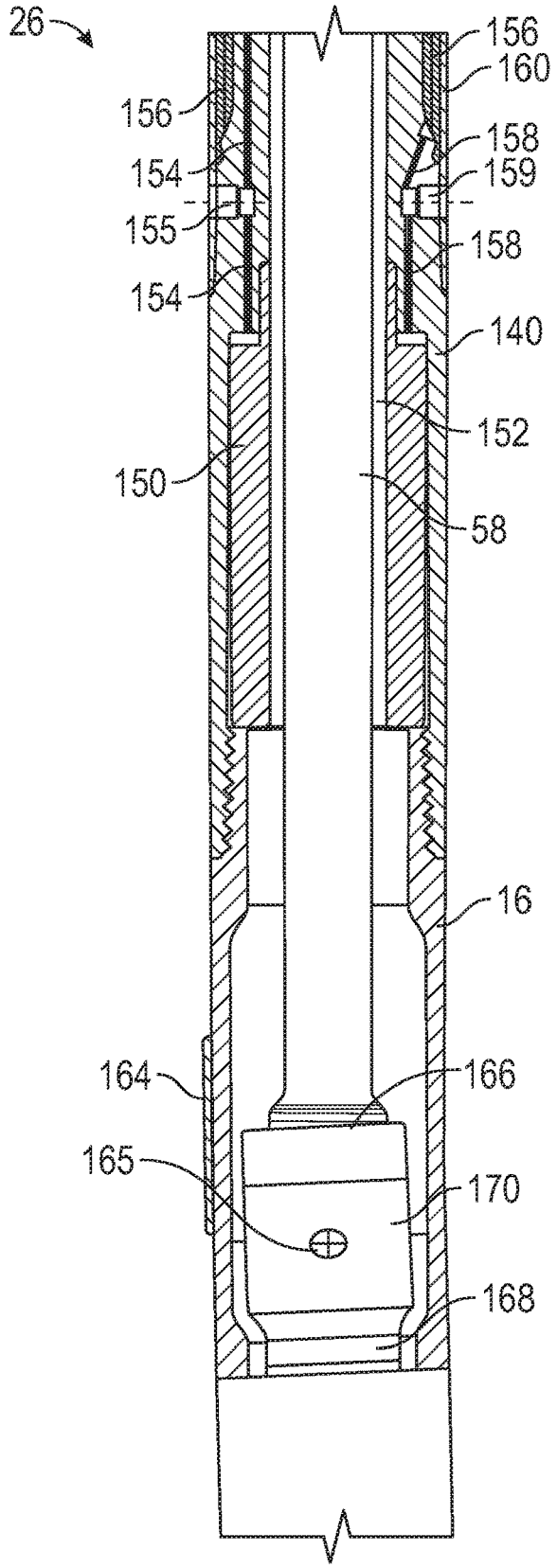

With reference to FIGS. 2 and 3F, a lower end of electronics housing 140 is secured to bent housing 16. An axis of the lower end of bent housing 16 is offset from an axis of the upper end of bent housing 16 to deviate drill bit 20 by a predetermined angle. Wear surface 164 is secured to an outer surface of bent housing 16 over bend point 165 of bent housing 16. A lower end of bent housing 16 is secured to bearing section 18. Lower shaft end 166 of transmission shaft 58 connects to bearing mandrel 168 through link 170. Link 170 may be a continuous velocity joint (i.e., C-V joint), flex shaft, or any other connection configured to transfer sufficient torque between transmission shaft 58 and bearing mandrel 168. Bent housing 16 rotates with swivel mandrel 30 and electrical housing 140 in the second direction at the variable rotation rate in relation to swivel housing 28 above. Transmission shaft 58 and bearing mandrel 168 rotate in the first direction at the rotor rotation rate relative to swivel housing 28 above. Bearing mandrel 168 in turn rotates drill bit 20 in the first direction at the rotor rotation rate relative to swivel housing 28 above. Bearing section 18 may include any combination of radial bearings and thrust bearings to transmit weight on bit from drill string 14 and to transmit torque and rotation from power section 12 to drill bit 20. Radial bearings in bearing section 18 absorbs side loading from drill bit 20. Bearing section 18 allows for the relative rotation between drill bit components (i.e, bearing mandrel 168 and drill bit 20) and lower end components (i.e., a housing of bearing section 18, bent housing 16, electronics section 26, swivel mandrel 30). In this way, swivel 24 (including swivel housing 28 and swivel mandrel 30) allows the lower end of drilling assembly 10 to rotate independently from the remainder of drilling assembly 10 and drill pipe 14 while transmitting weight on bit and overpull forces.

Figure 4:
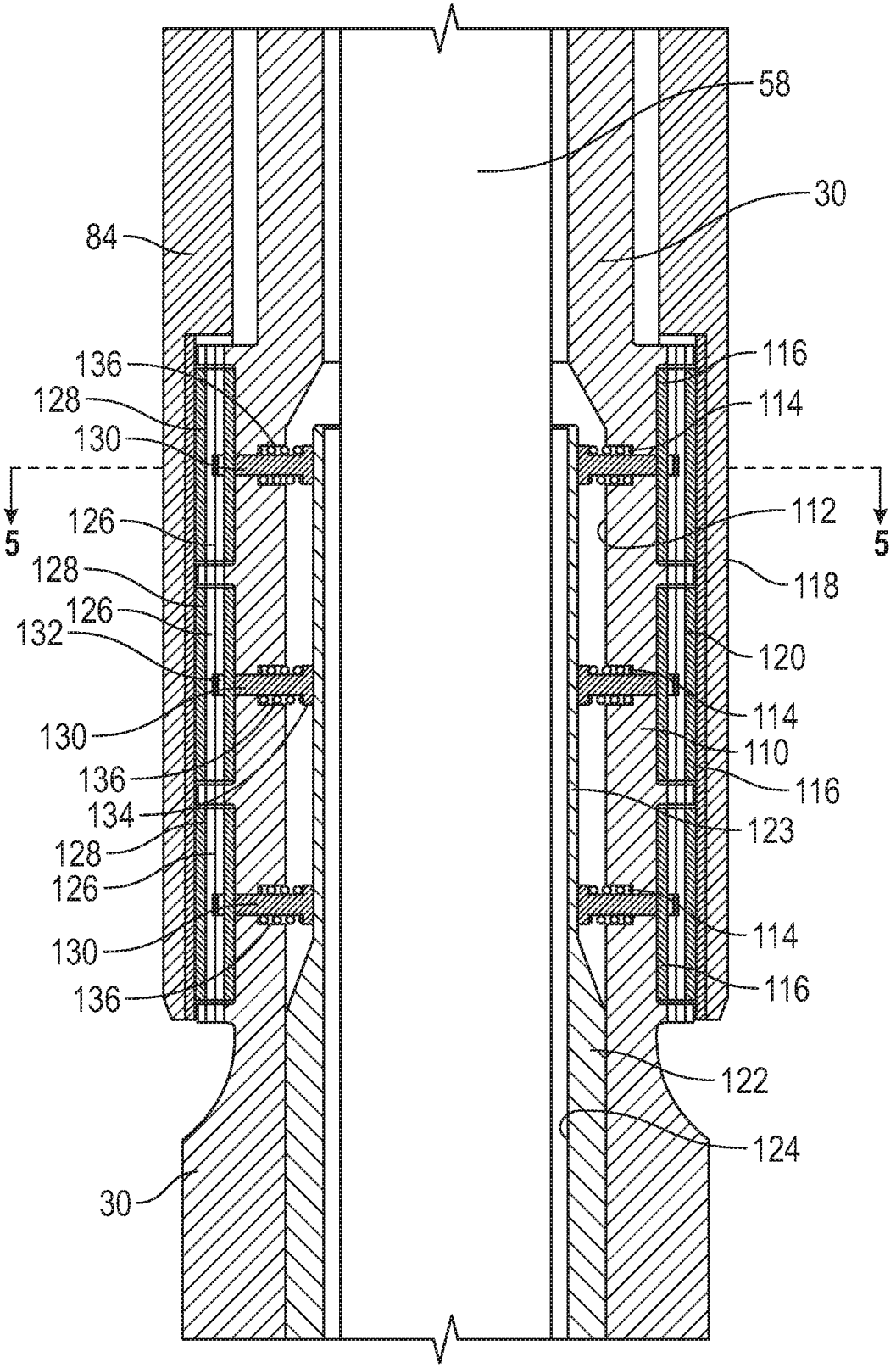
FIG. 4 is a detail cross-sectional view of a mechanical brake system of the drilling assembly shown in FIG. 1.
Figure 7:
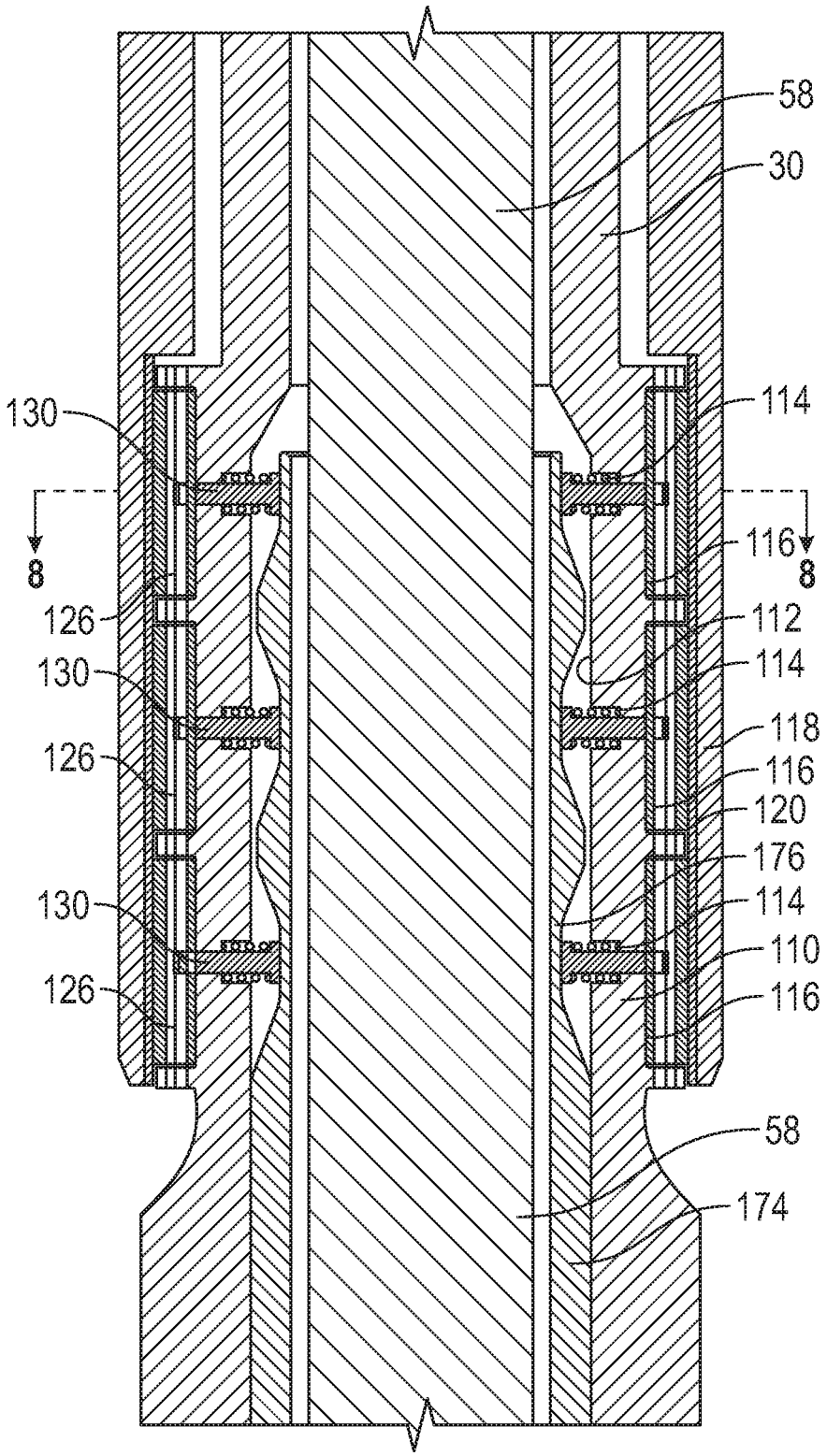
FIG. 7 is a detail cross-sectional view of an alternate mechanical brake system of the drilling assembly.
Figure 8:
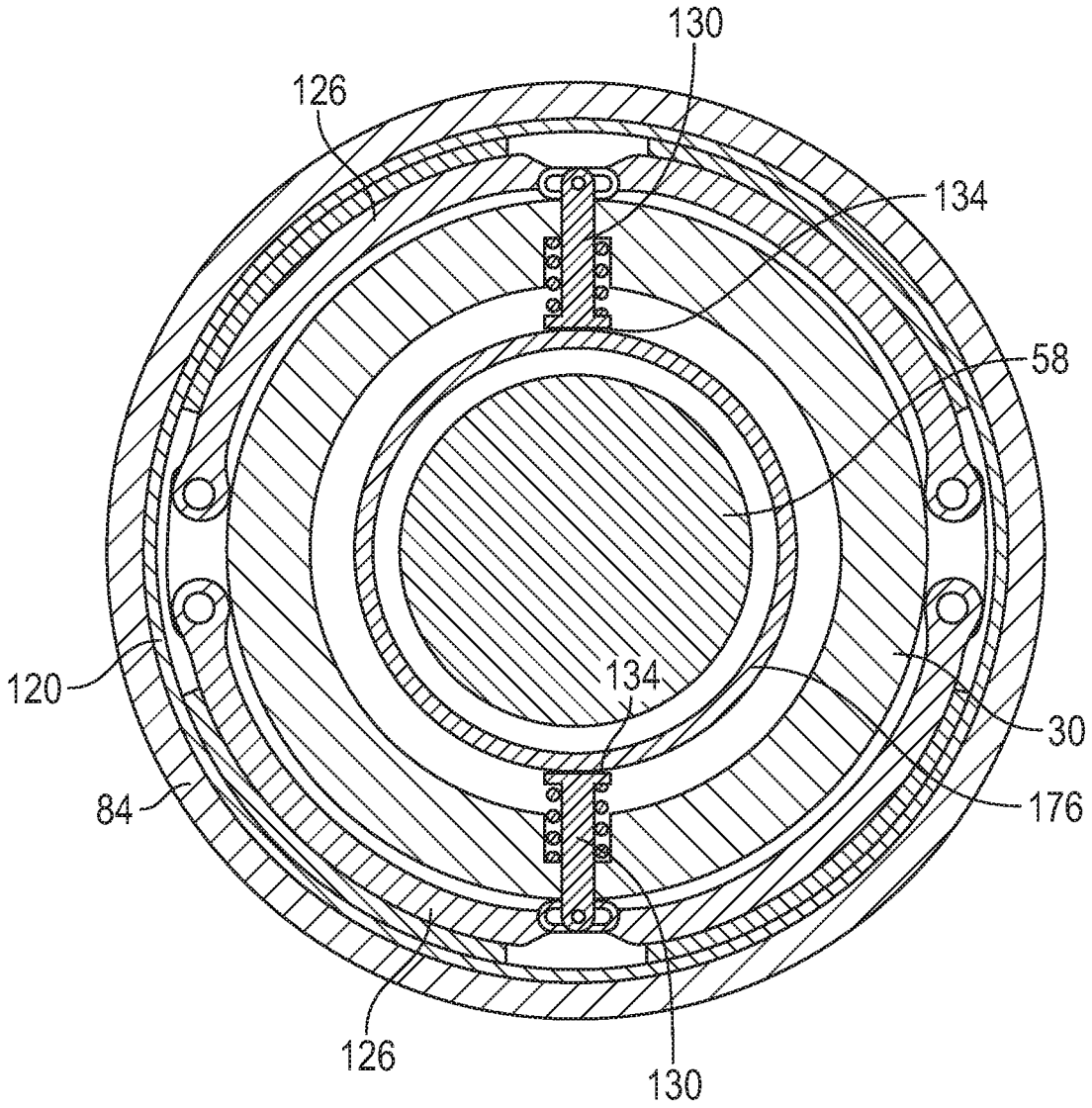
FIG. 8 is a cross-sectional view of the mechanical brake system taken along line B-B in FIG. 7, with the mechanical brake system in a default position.
Figure 9:
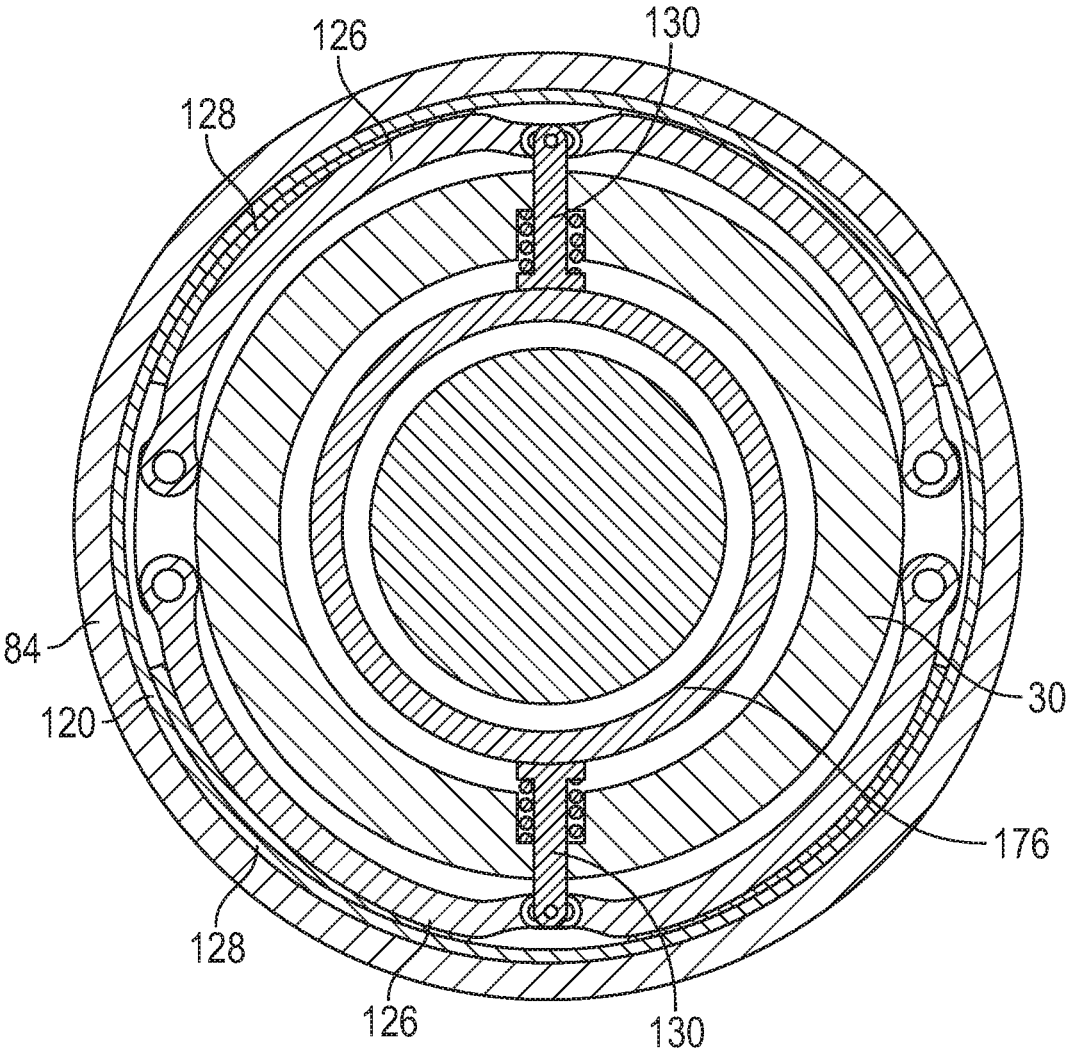
FIG. 9 is a cross-sectional view of the mechanical brake system taken along line B-B in FIG. 7, with the mechanical brake system in an actuated position.

FIGS. 7-9 illustrate another embodiment of the mechanical brake system including the same components as previously described with reference to FIGS. 4-6 except as otherwise described. Brake actuator 174 is disposed at least partially within swivel mandrel 30 with actuating portion 176 of brake actuator 174 disposed within expanded central bore 112 of middle portion 110 of swivel mandrel 30. Transmission shaft 58 is disposed through a central bore of brake actuator 174. An outer surface of actuating portion 176 has a generally sinusoidal axial profile. In the illustrated embodiment, the axial profile of actuating portion 176 includes three minimum diameter sections and three maximum diameter sections interconnected by sloped surfaces. In other embodiments, the axial profile of actuating portion 176 may include any number of minimum and maximum diameter sections interconnected by sloped surfaces. In a default position as illustrated in FIGS. 7 and 8, proximal end 134 of each brake shoe 130 engages the outer surface of actuating portion 176 of brake actuator 122 on a minimum diameter section. In an actuated position illustrated in FIG. 9, brake actuator 122 has displaced axially such that proximal end 134 engages the outer surface of actuating portion 176 of brake actuator 174 on a sloped surface or a maximum diameter section. In this actuated position, the increased diameter of brake actuator 174 pushes brake shoes 130 radially outward, thereby pushing brake pads 126 radially outward to compress wear surfaces 128 of brake pads 126 against wear surface 120 of swivel nut 84. In this actuated position, the mechanical brake system reduces the variable rotation rate of swivel mandrel 30 in the second direction relative to swivel housing 28 and swivel nut 84.

Figure 10:
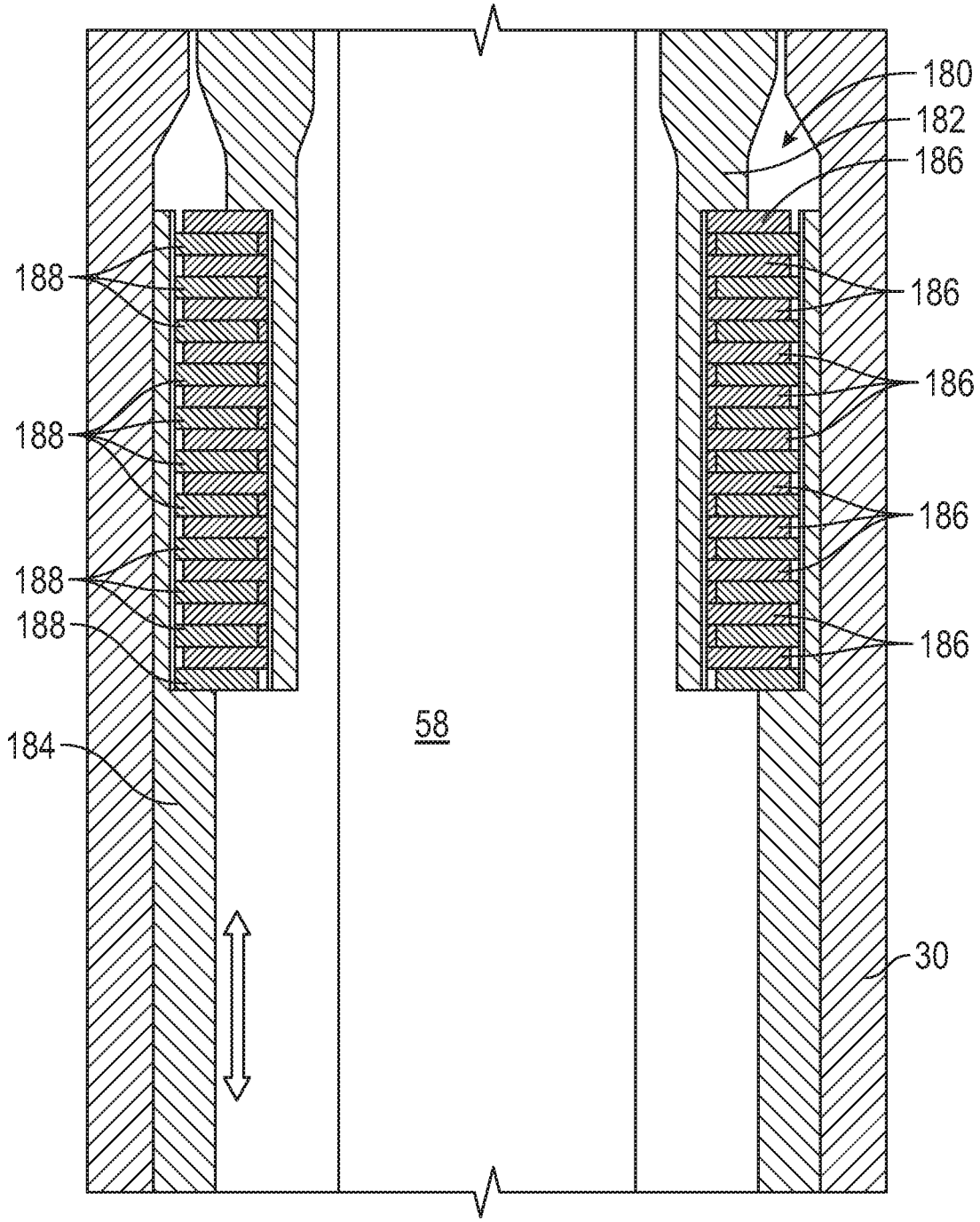
FIG. 10 is a detail cross-sectional view of a second alternate mechanical brake system of the drilling assembly.

FIG. 10 illustrates another embodiment of the mechanical brake system including the same components as previously described with reference to FIGS. 4-6 except as otherwise described. Brake actuator 180 includes first brake member 182 and second brake member 184. A lower end of first brake member 182 includes first clutch projections 186 extending from its outer surface. An upper end of second brake member 184 includes second clutch projections 188 extending from its inner surface, with second clutch projections 188 positioned between first clutch projections 186. As readily understood by a skilled artisan, brake actuator 180 may be used with drilling assembly 10 in a variety of ways. For example, first brake member 182 may be disposed within the central bore of swivel mandrel 30 and may rotate with swivel mandrel 30 in the second direction at the variable rotation rate. Second brake member 184 may be operatively connected to gear 148, and may not rotate. When activated by gear 148, second brake member 184 may be displaced axially upward to compress first and second clutch projections 186 and 188, thereby reducing the variable rotation rate of first brake member 182 and swivel mandrel 30.

Figure 11:
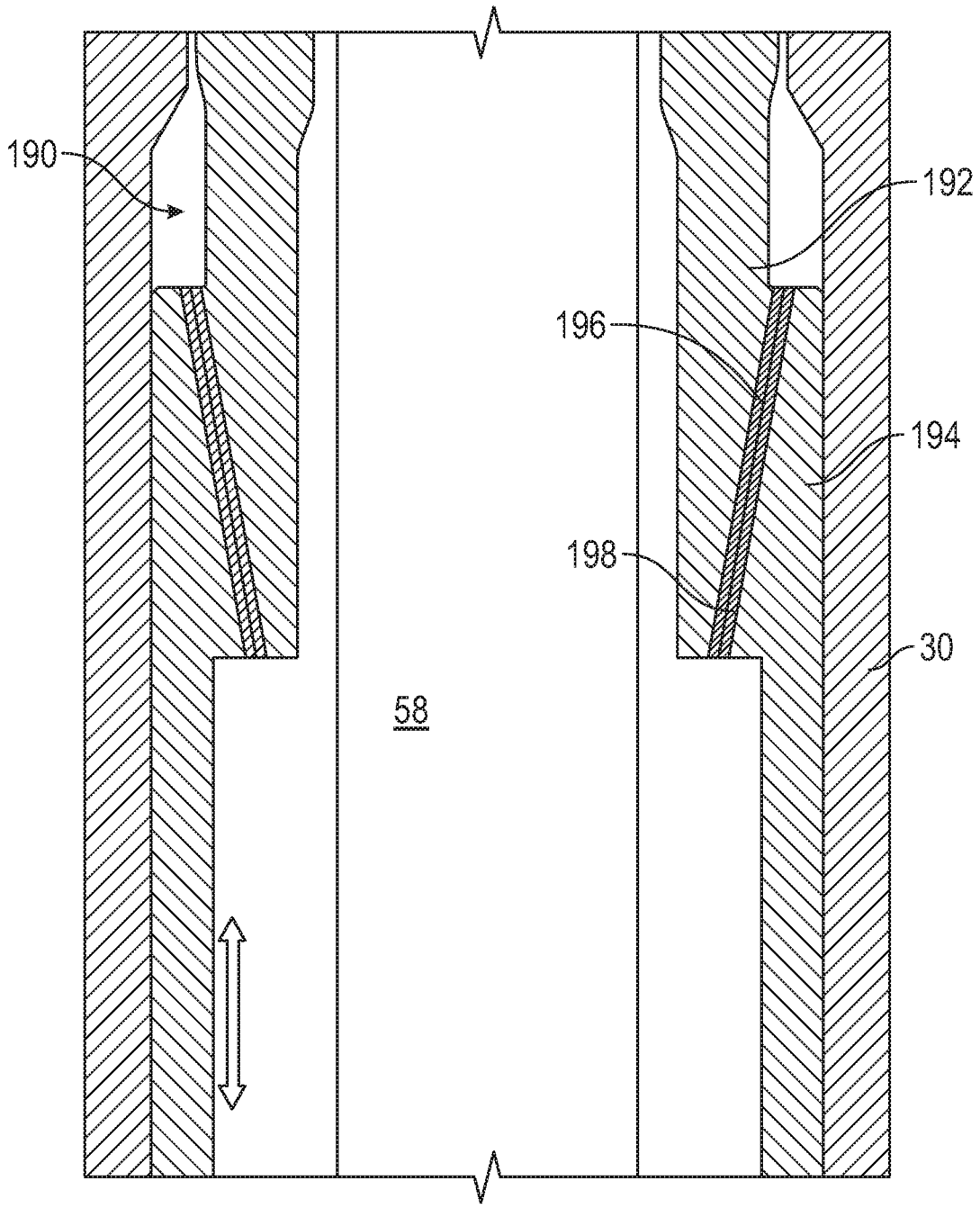
FIG. 11 is a detail cross-sectional view of a third alternate mechanical brake system of the drilling assembly.

FIG. 11 illustrates yet another embodiment of the mechanical brake system including the same components as previously described with reference to FIGS. 4-6 except as otherwise described. Brake actuator 190 includes first brake member 192 and second brake member 194. A lower end of first brake member 192 includes sloped wear surface 196. An upper end of second brake member 194 includes sloped wear surface 198, which has a reciprocal slope to slope wear surface 196. Sloped wear surfaces 196 and 198 contact one another in a default position. As readily understood by a skilled artisan, brake actuator 190 may be used with drilling assembly 10 in a variety of ways. For example, first brake member 192 may be disposed within the central bore of swivel mandrel 30 and may rotate with swivel mandrel 30 in the second direction at the variable rotation rate. Second brake member 194 may be operatively connected to gear 148, and may not rotate. When activated by gear 148, second brake member 194 may be displaced axially upward to compress sloped wear surfaces 196 and 198, thereby reducing the variable rotation rate of first brake member 192 and swivel mandrel 30.

Figure 12:
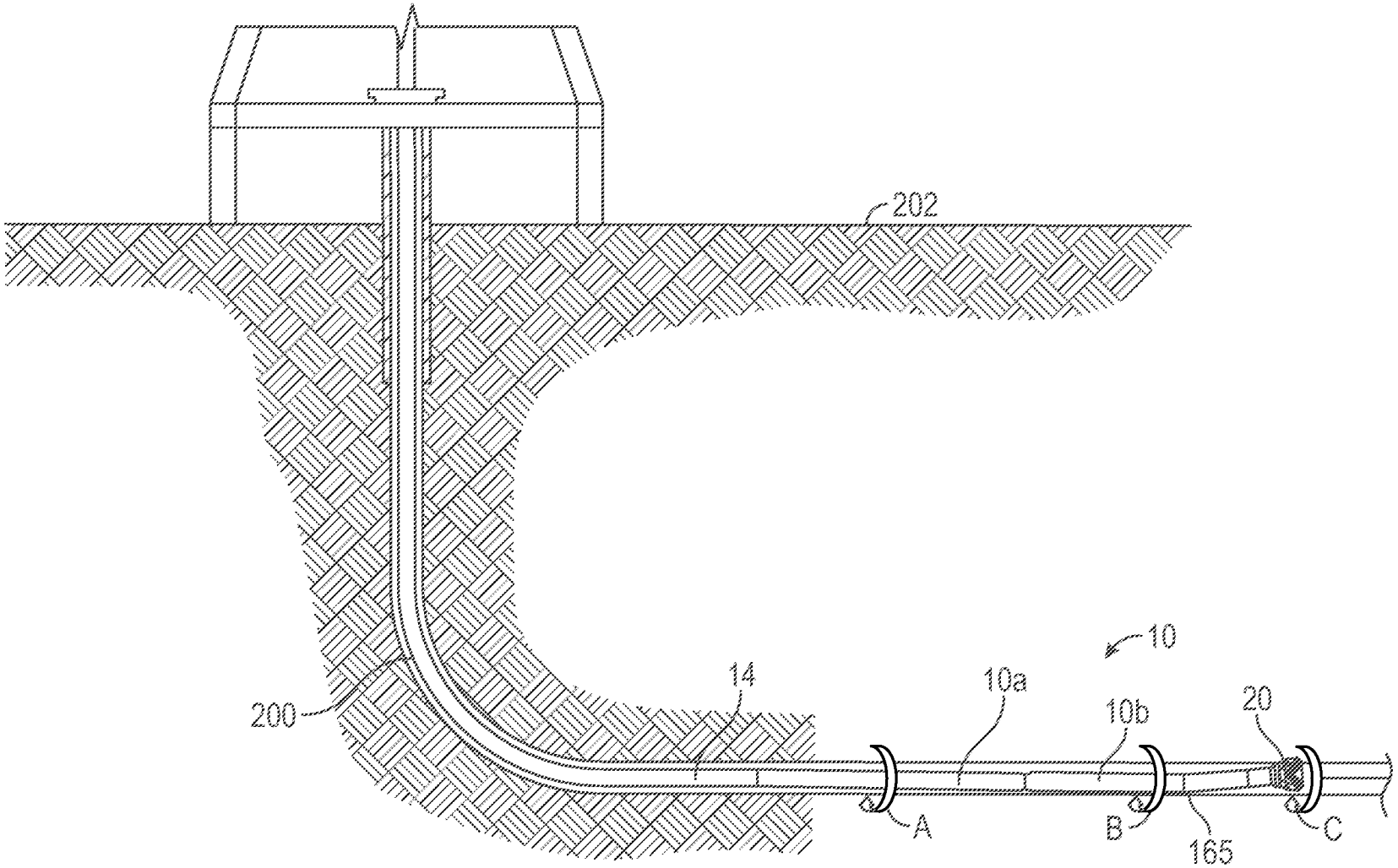
FIG. 12 is a schematic view of a drilling assembly operating in a rotary mode.

With reference to FIG. 12, drilling assembly 10 may be disposed within wellbore 200 extending from surface 202 into a subterranean formation. Wellbore 200 may include one or more bends or curves in direction and inclination, such as those created in directional drillings applications. Drilling assembly 10 may be secured to a lower end of drill string 14 for further drilling of wellbore 200. Drilling assembly 10 includes upper portion 10*a*, lower portion 10*b*, and drill bit 20. Upper portion 10*a* includes MWD section 32, receiving sub 34, power section 12, orienting section 22, and swivel housing 28 (shown in FIG. 1), while lower portion 10*b* includes swivel mandrel 30, electronics section 26, bent housing 16, and bearing section 18 (shown in FIG. 1).

FIG. 12 illustrates drilling assembly 10 in a rotary mode. Upper portion 10*a* rotates in a first direction at a drill string rotation rate relative to the subterranean reservoir and wellbore 200 (illustrated by arrow A), along with a rotation of drill string 14. Lower portion 10*b* rotates in a second direction (opposite to the first direction) at a variable rotation rate relative to upper portion 10*a*. Because the variable rotation rate is less than the drill string rotation rate in the first direction, lower portion 10*b* effectively rotates in the first direction at a variable rotation rate relative to the subterranean reservoir and wellbore 200 (illustrated by arrow B). Drill bit 20 rotates in the first direction at a drill bit rotation rate (illustrated by arrow C). The drill bit rotation rate is the sum of the drill string rotation rate and a rotor rotation rate provided by rotor 44 of power section 12. In this rotary mode, bend point 165 of bent housing 16 continuously rotates (i.e., moves around a circumference of wellbore 200). The continuation rotation of bent housing 16 causes drill bit 20 to move in a circular pattern within wellbore 200 (i.e., around a circumference of wellbore 200), thereby drilling wellbore 200 further in the same direction (i.e., a straight line without a bend). The magnitude of the variable rotation rate of lower portion 10*b* in the second direction should be less than the magnitude of the drill string rotation rate in the first direction to prevent backing off the threaded connections of lower portion 10*b*.

Figure 13:
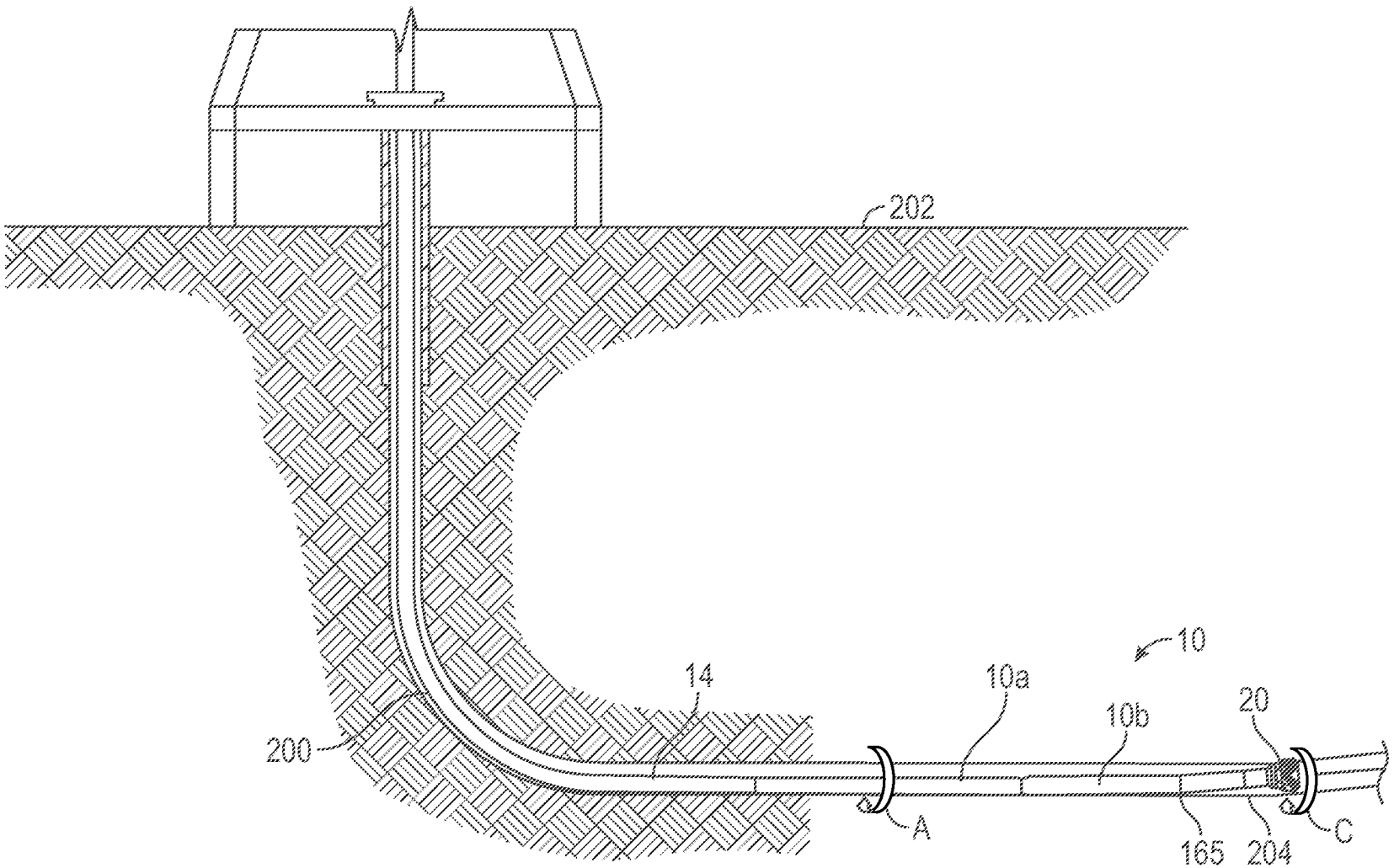
FIG. 13 is a schematic view of the drilling assembly operating in a sliding mode.

FIG. 13 illustrates drilling assembly in a sliding mode. Upper portion 10*a* rotates in a first direction at the drill string rotation rate relative to the subterranean reservoir and wellbore 200 (illustrated by arrow A), along with a rotation of drill string 14. Lower portion 10*b* rotates in a second direction (opposite the first direction) at a variable rotation rate relative to upper portion 10*a*. In the sliding mode, the variable rotation rate of lower portion 10*b* is equal in magnitude to the drill string rotation rate of the upper portion 10*a*, such that lower portion 10*b* effectively does not rotate relative to the subterranean formation and wellbore 200. Drill bit 20 rotates in the first direction at a drill bit rotation rate (illustrated by arrow C). The drill bit rotation rate is the sum of the drill string rotation rate and a rotor rotation rate provided by rotor 44 of power section 12. In this sliding mode, lower portion 10*b* and bend point 165 of bent housing 16 do not rotate, thereby maintaining the position of drill bit 20 along a circumference of wellbore 200. In other words, bend point 165 directs drill bit 20 in the same direction and inclination to provide bend 204 in wellbore 200. A user may place drilling assembly 10 in the sliding mode when an adjustment is desired in a direction or an inclination of wellbore 200. With lower portion 10*b* rotating at the same rotation rate in an opposite direction relative to upper portion 10*a*, these adjustments in direction and inclination of wellbore 200 may be made while continuously rotating drill string 14. This continuous rotation eases the frictional forces that must be overcome in drilling wellbore 200 because dynamic friction (sliding with rotation) is less than static friction (sliding without rotation).

Referring again to FIGS. 3A-3F, drilling assembly 10 may be programmed to automatically adjust the variable rotation rate of lower portion 10*b* based solely on a magnitude of the drill string rotation rate. Sensors in cavity 144 or in control unit 150 detect the drill string rotation rate. Other components within control unit 150, such as one or more CPUs, processors, microprocessors, and memory devices, receive the rotation rate measurement from the sensors and send instructions to motor 146 and gear 148 through electronic connections 154. Based on the instructions, gear 148 adjusts brake actuator 122, thereby adjusting the brake torque applied by brake pads 126 to swivel nut 84, which in turn adjusts the variable rotation rate of swivel mandrel 30 in the second direction relative to swivel nut 84.

In one embodiment, the variable rotation rate of swivel mandrel 30 in the default position illustrated in FIG. 5 is equal to magnitude of the drill string rotation rate such that swivel mandrel 30 (and lower portion 10*b*) effectively does not rotate relative to the subterranean formation and wellbore 200. Adjusting the mechanical brake system to the actuated position illustrated in FIG. 6 reduces the variable rotation rate of swivel mandrel 30 to a value less than the drill string rotation rate such that swivel mandrel 30 (and lower portion 10*b*) effectively rotates in the first direction relative to the subterranean formation and wellbore 200. In this embodiment, the default position of the mechanical brake system places drilling assembly 10 is the sliding mode illustrated in FIG. 13, and the actuated position of the mechanical brake system places drilling assembly 10 in the rotary mode illustrated in FIG. 12.

In another embodiment, the variable rotation rate of swivel mandrel 30 in the default position illustrated in FIG. 5 is less than the magnitude of the drill string rotation rate such that swivel mandrel 30 (and lower portion 10*b*) effectively rotates in the first direction relative to the subterranean formation and wellbore 200. Reducing the drill string rotation rate may automatically adjust the mechanical brake system to the actuated position illustrated in FIG. 6 to reduce the variable rotation rate of swivel mandrel 30 to a value equal to the magnitude of the drill string rotation rate such that swivel mandrel 30 (and lower portion 10*b*) effectively does not rotate relative to the subterranean formation and wellbore 200. In this embodiment, the default position of the mechanical brake system places drilling assembly in the rotary mode illustrated in FIG. 12, and the actuated position of the mechanical brake system places drilling assembly in the sliding mode illustrated in FIG. 13.

For example, in rotary mode, the drill string rotation rate may be 120 RPM in the first direction and the variable rotation rate in the second direction of swivel mandrel 30 may be 90 RPM relative to the drill string and upper portion 10*a*, with the mechanical brake system in the default position. Therefore in this embodiment, swivel mandrel 30 effectively rotates at a rotation rate of 30 RPM in the first direction relative to the subterranean formation and wellbore 200. When a change in direction and inclination of drill bit 20 is desired, the user at surface 202 may reduce the drill string rotation rate of drill string 14 from 120 RPM to 80 RPM. Control unit 150 may detect the change in the drill string rotation rate of more than a threshold value (e.g., more than 30 RPM). In response to this detected change, control unit 150 may automatically place drilling assembly 10 in the sliding mode by activating the mechanical brake system to reduce the variable rotation rate of swivel mandrel 30 from 90 RPM to a value that equals the magnitude of the current detected drill string rotation rate (e.g., 80 RPM), such that swivel mandrel 30 effectively does not rotate relative to the subterranean formation and wellbore 200. In this way, drilling assembly 10 is automatically placed in a sliding mode in response to a detected change in the drill string rotation rate, and the drill string is allowed to continue rotating in the sliding mode. When sliding mode is no longer needed, the user at surface 202 may increase the drill string rotation rate of drill string 14 by more than a threshold value (e.g., increasing the drill string rotation rate to 120 RPM again). When control unit 150 detects this change in the drill string rotation rate, control unit 150 deactivates or releases the mechanical brake system to return the mechanical brake system to the default position.

In one embodiment, one or more CPUs, processors, microprocessors, and memory devices in control unit 150 are programmed to adjust the setting of drilling assembly 10 between rotary mode and sliding mode based on the drill string rotation rate. In one embodiment, a first range of the drill string rotation rate may be assigned for sliding mode, such that drilling assembly 10 is placed in the sliding mode when the drill string rotation rate is in the first range and drilling assembly 10 is placed in the rotary mode when the drill string rotation rate is outside of the first range. For example, but not by way of limitation, the first range may be 50-80 rpm, or any subrange therein. In another embodiment, a first range of the drill string rotation rate may be assigned for rotary mode, such that drilling assembly 10 is placed in the rotary mode when the drill string rotation rate is in the first range and drilling assembly 10 is placed in the sliding mode when the drill string rotation rate is outside of the first range.

In sliding mode, drilling assembly 10 maintains the current tool face of drill bit 20. If the drill string rotation rate momentarily increases or decreases, drilling assembly 10 compensates to ensure that the sliding mode is maintained, hence it will adjust the tool face accordingly. Electronics section 26 increases or decreases the brake torque to change the variable rotation rate of lower portion 10*b*, thereby adjusting the tool face. When adjusting the tool face of lower portion 10*b* in sliding mode, the inclination and direction of the drilling assembly will change to allow the driller at the surface to drill with drilling assembly 10 in sliding mode while the drill pipe is rotating. Drilling assembly 10 may also automatically determine a desired tool face when switching from rotary mode to sliding mode. Electronics section 26 may record that tool face and maintain it until further drill string rotation rate adjustments. When a tool face change is desired, the user may increase the drill string rotation rate for a period of time. Electronics section 26 senses the increase in drill string rotation rate and, after a specified period of time, electronics section 26 will adjust the brake torque to progress the tool face to either direction a specified amount, such as but not limited to 20 degrees. The tool face adjustments may continue periodically until the user decreases the drill string rotation rate back to a baseline rate. Electronics section 26 may then maintain the new tool face. This process may be repeated to select a desirable tool face of drill bit 20.

In rotary mode, drilling assembly 10 may only ensure that lower portion 10*b* is rotating within a predefined safe operating limit. A minimum variable rotation rate is required to achieve the dynamic friction benefits of rotation. The variable rotation rate should not exceed a maximum value in order to avoid or reduce the risk of premature failure due to fatigue. In rotary mode, electronics section 26 will only adjust brake torque to ensure that the variable rotation rate of lower end 10*b* is within these limits.

Figure 14:
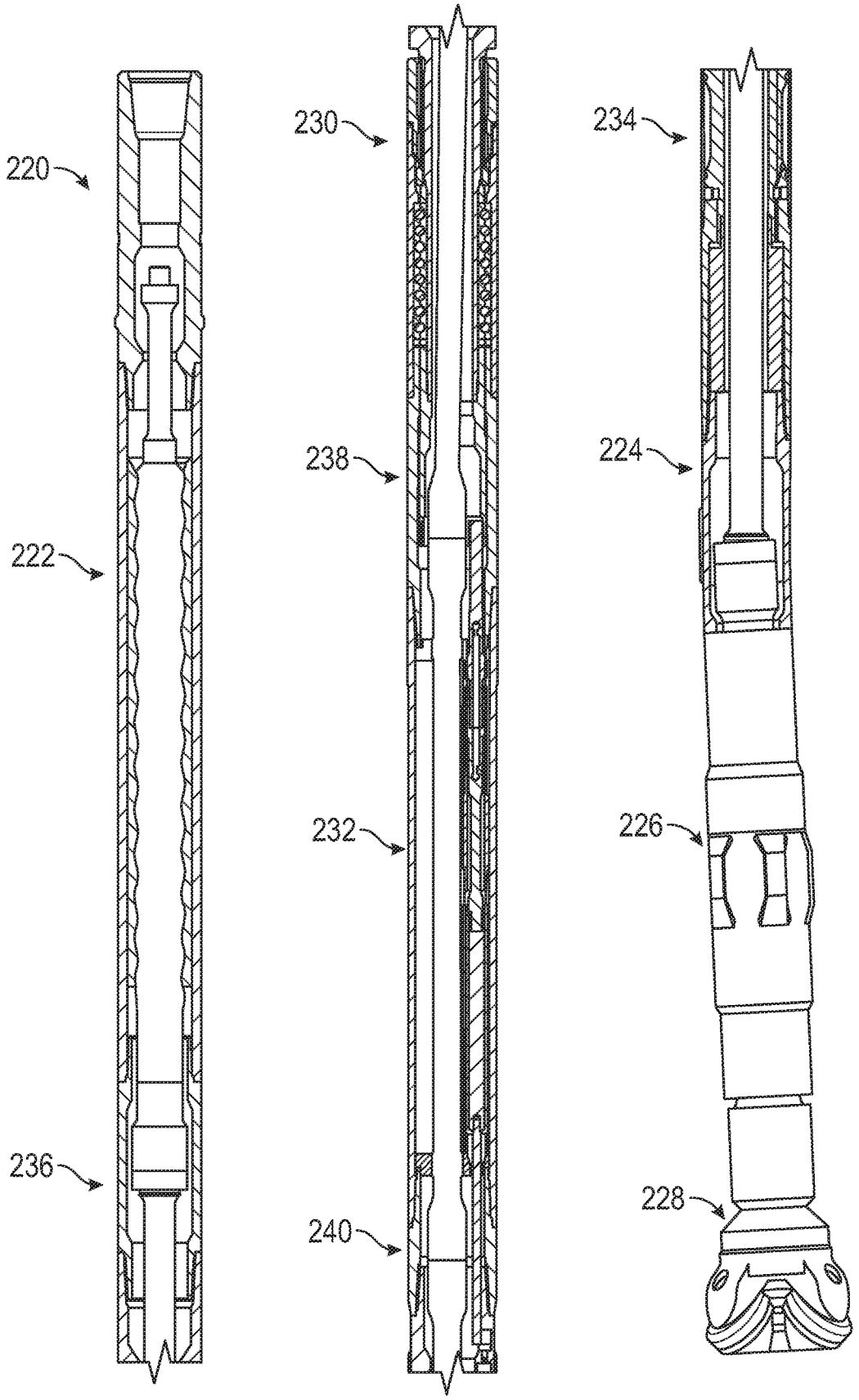
FIG. 14 is a cross-sectional view of another embodiment of the drilling assembly.

FIG. 14 illustrates another embodiment of the bore hole drilling assembly. Drilling assembly 220 includes power section 222 disposed below a drill string. Bent housing 224 and bearing section 226 are disposed between power section 222 and drill bit 228. Swivel 230, orienting section 232, and electronics section 234 may be disposed between power section 222 and drill bit 228. Power crossover sub 236 may be disposed between power section 222 and swivel 230. Orienting crossover sub 238 may be disposed between swivel 230 and orienting section 232. Brake crossover sub 240 may be disposed between orienting section 232 and electronics section 234. Like drilling assembly 10, drilling assembly 220 may also include a MWD section and a receiver sub (not shown) disposed above power section 222. As explained in more detail below, rotation of a drill string above power section 222 in a first direction at a drill string rotation rate rotates power section 222, power crossover sub 236, and an upper portion of swivel 230 in the first direction at the drill string rotation rate. Orienting section 232 rotates a lower portion of swivel 230, orienting crossover sub 238, orienting section 232, brake crossover sub 240, electronics section 234, bent housing 224, and bearing section 226 in a second direction at a variable rotation rate. The second direction may be opposite the first direction.

Figure 15A:
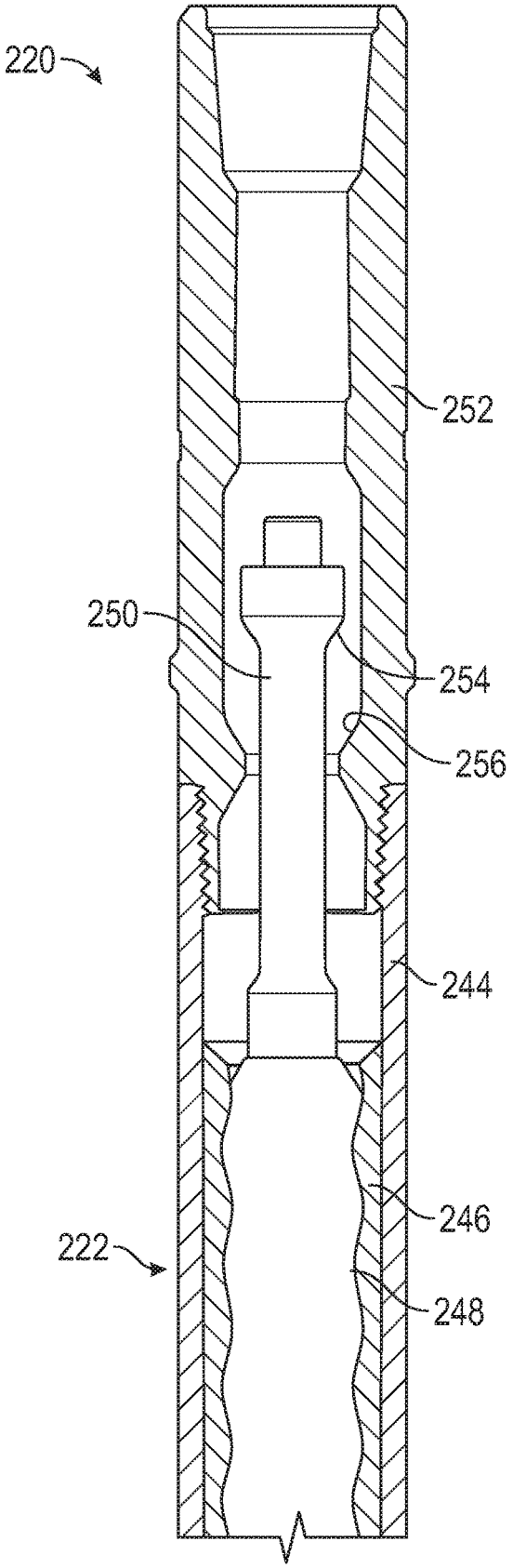
FIGS. 15A-15F are sequential cross-sectional views of the drilling assembly shown in FIG. 14.
Figure 15B:
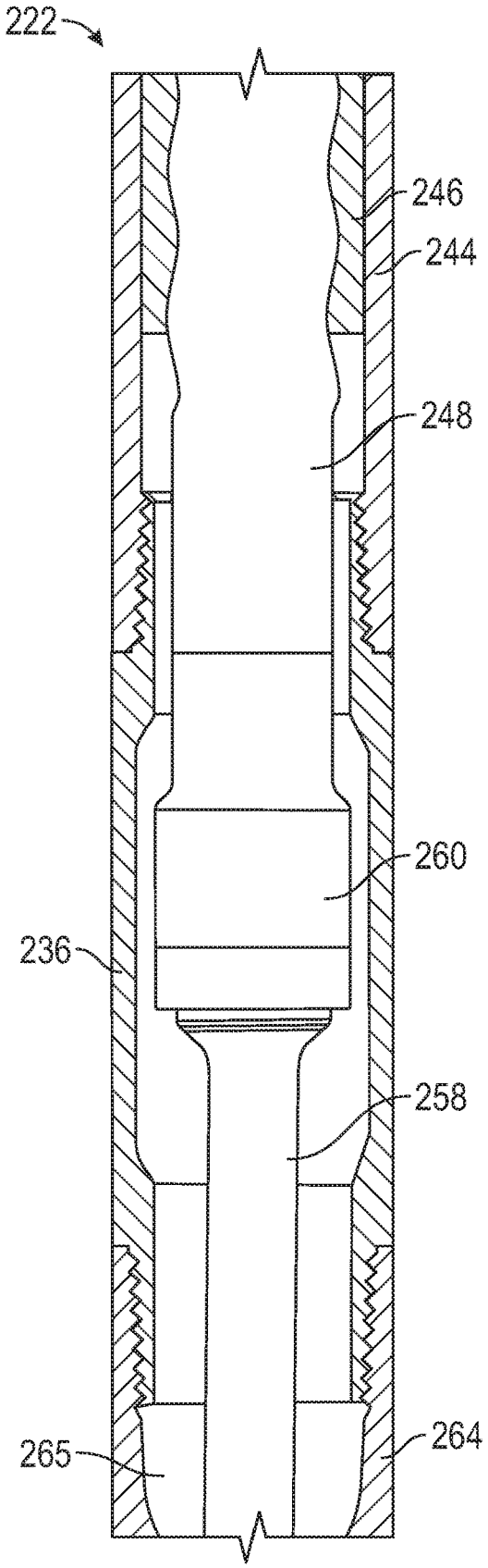

With reference to FIGS. 14 and 15A-15B, power section 222 includes power section housing 244 with power stator 246 secured to an inner wall of power section housing 244 and with power rotor 248 disposed within a central bore of power stator 246. As readily understood by skilled artisans, a fluid flow through cavities formed between the outer surface profile of power rotor 248 and the inner surface profile of power stator 246 causes power rotor 248 to rotate relative to power stator 246 and power section housing 244. Power section 222 is configured to rotate power rotor 248 in the same direction as the rotation of power stator 246. In this way, power section 222 converts hydraulic horsepower from a drilling fluid into mechanical (rotational) horsepower to drive drill bit 228 with the power section output (power rotor 248 in this embodiment). Catch 250 may be attached to an upper end of power rotor 248 for any potential separation of housing connections below top sub 252. Catch 250 may include shoulder 254 designed to engage shoulder 256 within top sub 252 to retain catch 250 within top sub 252. Top sub 252 may be connected to the drill string above through a MWD section and a receiver sub. In this way, a rotation of the drill string in a first direction at a drill string rotation rate causes top sub 252, power section housing 244, and power stator 246 to all rotate in the first direction at the drill string rotation rate. A fluid flow through power section 222 causes power rotor 248 to rotate in the first direction at a rotor rotation rate relative to power section housing 244.

With reference to FIGS. 14 and 15B, power crossover sub 236 may be secured below power section 222. A lower end of power rotor 248 extends into the inner bore of power crossover sub 236 where it is attached to transmission shaft 258 via connection 260. Transmission shaft 258 may be a continuous velocity joint (i.e., C-V joint), flex shaft, or any other connection shaft configured to transfer sufficient torque between power rotor 248 and drill bit 228. Power crossover sub 236 is a pin-by-pin sub configured to connect power section 222 to orienting section 232. Power crossover sub 236 rotates in the first direction at the drill string rotation rate with power section housing 244. Transmission shaft 258 rotates in the first direction at the rotor rotation rate relative to power crossover sub 236.

Figure 15C:
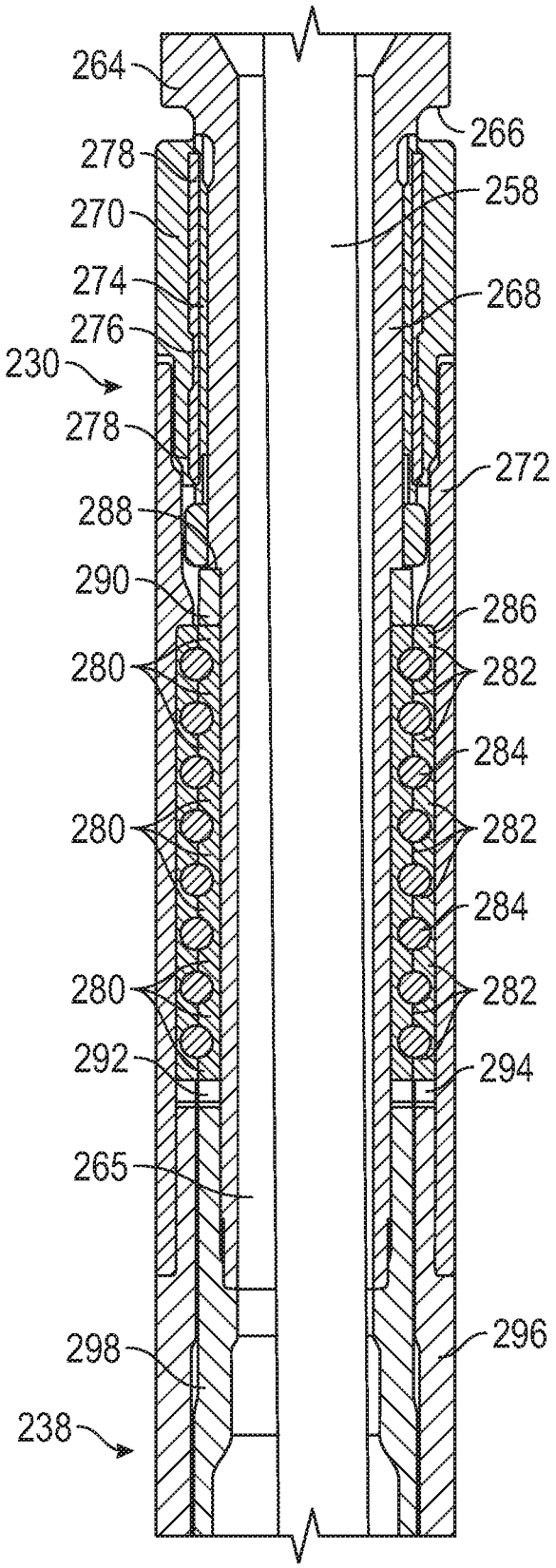

Referring to FIGS. 14 and 15B-15C, swivel 230 may include swivel base 264 attached to a lower end of power crossover sub 236 such that swivel base 264 rotates in the first direction with power crossover sub 236 and power section housing 244. Swivel base 264 may include central bore 265 dimensioned to allow transmission shaft 258 to extend therethrough. Swivel base 264 may also include shoulder 266 separating an upper portion from lower portion 268 having a reduced diameter. Swivel 230 may also include swivel nut 270 and swivel mandrel 272 secured to a lower end of swivel nut 270. Swivel nut 270 and swivel mandrel 272 may be disposed around lower portion 268 of swivel base 264. Swivel nut 270 and swivel mandrel 272 rotate in the second direction, opposite the first direction, at a variable rotation rate relative to swivel base 264, as described in more detail below.

Swivel 230 includes bearings to provide for the relative rotation between swivel base 264 and swivel nut 270 and swivel mandrel 272. Any combination of radial and thrust bearings may be disposed in an annular space between swivel base 264 and swivel nut 270 and swivel mandrel 272. In the illustrated embodiment, upper radial bearing 274 may be disposed in an annular space between swivel nut 270 and swivel base 264 to absorb a bending moment between swivel base 264 and the lower part of drilling assembly 220. Upper radial bearing 274 rotates with swivel base 264 in the first direction at the drill string rotation rate. An outer surface of upper radial bearing 274 may include wear surface 276 formed of a hard facing material. An inner surface of swivel nut 270 may include one or more wear surfaces 278 formed of a hard facing material. Wear surface 276 of upper radial bearing 274 engages wear surfaces 278 of swivel nut 270 to provide the radial bearing function. In another embodiment, upper radial bearing 274 is disposed in an annular space between swivel mandrel 272 and swivel base 264. A thrust bearing is disposed in the annular space between swivel mandrel 272 and swivel base 264 to transmit weight on bit and overpull forces. The thrust bearing may be formed of inner thrust races 280, outer thrust races 282, and spherical members 284 disposed between inner and outer thrust races 280, 282 as illustrated. Inner thrust races 280 rotate with swivel base 264 in the first direction at the drill string rotation rate, while outer thrust races 282 rotate with swivel mandrel 272 in the second direction at the variable rotation rate relative to swivel base 264. Outer thrust races 282 may be secured in the annular space between swivel mandrel 272 and swivel base 264 by internal shoulder 286 of swivel mandrel 272, while inner thrust races 280 may be secured in the annular space by external shoulder 288 of swivel base 264. In one embodiment, spacer 290 is disposed between external shoulder 288 of swivel base 264 and inner thrust bearings 280. Inner lower radial bearing 292 and outer lower radial bearing 294 are disposed between swivel mandrel 272 and swivel base 264. Inner lower radial bearing 292 is disposed below inner thrust races 280, and rotates with swivel base 264 in the first direction at the drill string rotation rate. Outer lower radial bearing 294 is disposed below outer thrust races 282, and rotates with swivel mandrel 272 in the second direction at the variable rotation rate relative to swivel base 264. Inner lower radial bearing 292 engages outer lower radial bearing 294 to absorb any side loading of swivel mandrel 272.

Figure 15D:
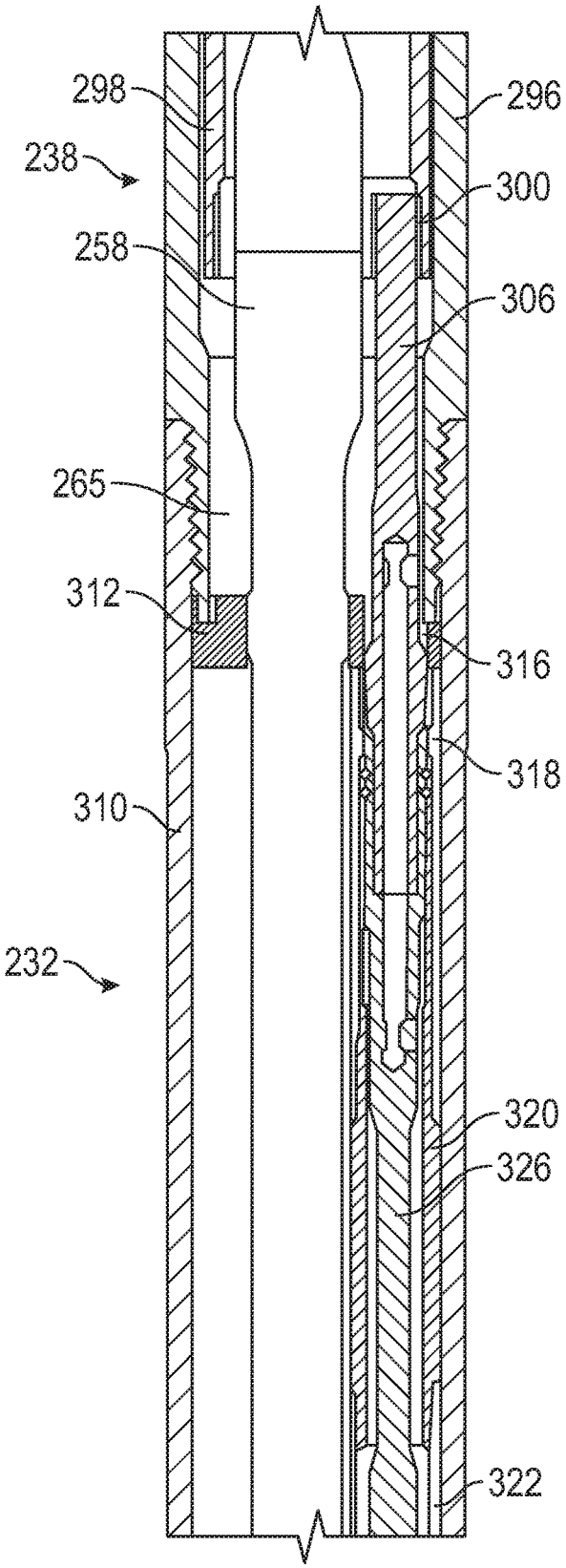

With reference to FIGS. 14 and 15C-15D, orienting crossover sub 238 includes housing 296 secured to a lower end of swivel mandrel 272 such that housing 296 rotates with swivel mandrel 272 in the second direction at the variable rotation rate. Base 298 is disposed within housing 296 and is secured to a lower end of swivel base 264. Base 298 rotates in the first direction at the drill string rotation rate. Transmission shaft 258 is disposed through a central bore of base 298. A lower end of base 298 includes ring gear 300. An upper gearwheel of upper orienting shaft 306 of an orienting motor (in orienting section 232) may be fitted into ring gear 300.

Referring to FIGS. 15D-15E and FIGS. 16A-16C, orienting section 232 may include orienting housing 310 secured to a lower end of housing 296 of orienting crossover sub 238. Orienting housing 310 rotates in the second direction at a variable rotation rate with housing 296 of orienting crossover sub 238. Transmission shaft 258 is disposed through orienting housing 310, and rotates at the rotor rotation rate relative to swivel base 264. Upper guide 312 is disposed within orienting housing 310 near its upper end. Upper guide 312 is configured to separate transmission shaft 258 from the orienting motor and to maintain the position of the orienting motor and transmission shaft 258 within orienting housing 310. Transmission shaft 258 may be disposed through an offset bore of upper guide 312. Upper guide 312 may also include top groove 314 (shown in FIG. 16A) configured to receive the lower end of housing 296 of orienting crossover sub 238. Upper guide 312 may further include motor bore 316 configured to receive upper orienting shaft 306 of the orienting motor. The orienting motor may also be disposed within orienting housing 310. The orienting motor includes an orienting frame comprising upper orienting frame 318, middle orienting frame 320, and lower orienting frame 322 secured to one another in sequence as illustrated. Upper orienting frame 318 abuts a lower surface of upper guide 312 near motor bore 316. Upper guide 312 may be secured in its axial position by the lower end of housing 296 of orienting crossover sub 238 and upper orienting frame 318. The orienting frame is secured to an inner surface of orienting housing 310 such that the orienting frame travels in a circular path as orienting housing 310 rotates. The orienting motor also includes orienting stator 324 disposed within a central bore of lower orienting frame 322. The orienting motor further includes upper orienting shaft 306 with its gearwheel disposed in ring gear 300, lower orienting shaft 326 secured to a lower end of upper orienting shaft 306, and orienting rotor 328 secured to a lower end of lower orienting shaft 326. Orienting rotor 328 is disposed at least partially through a central bore of orienting stator 324. As readily understood by skilled artisans, a fluid flow through cavities formed between the outer surface profile of orienting rotor 328 and the inner surface profile of orienting stator 324 causes relative rotation between orienting rotor 328 and orienting stator 324.

In one embodiment, orienting stator 324 is rotationally locked to orienting housing 310 such that orienting stator 324 does not rotate relative to orienting housing 310. A fluid flow through the orienting motor may cause orienting rotor 328, lower orienting shaft 326, and upper orienting shaft 306 to rotate relative to orienting stator 324 and orienting housing 310. The interaction of the gearwheel at the upper end of upper orienting shaft 306 with ring gear 300 in base 298 (which is rotating at the drill string rotation rate in the first direction) may cause orienting stator 324, orienting housing 310, and the rest of the lower end of drilling assembly 220 to rotate at a variable rotation rate in a second direction (opposite the first direction) relative to swivel base 264 and the drill string above.

Figure 16A:
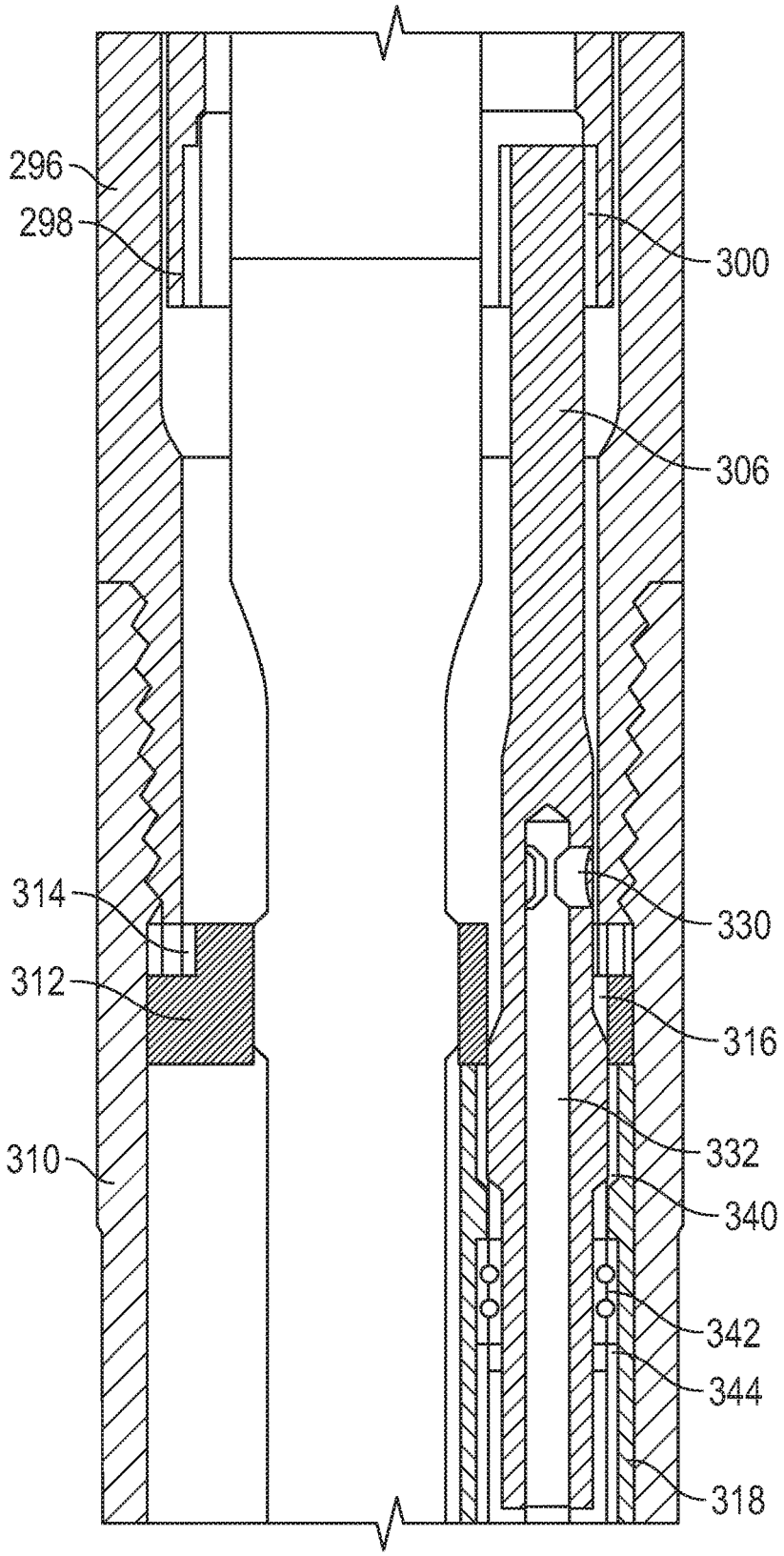
FIGS. 16A-16C are sequential detailed cross-sectional views of an orienting section of the drilling assembly shown in FIG. 14.
Figure 16B:
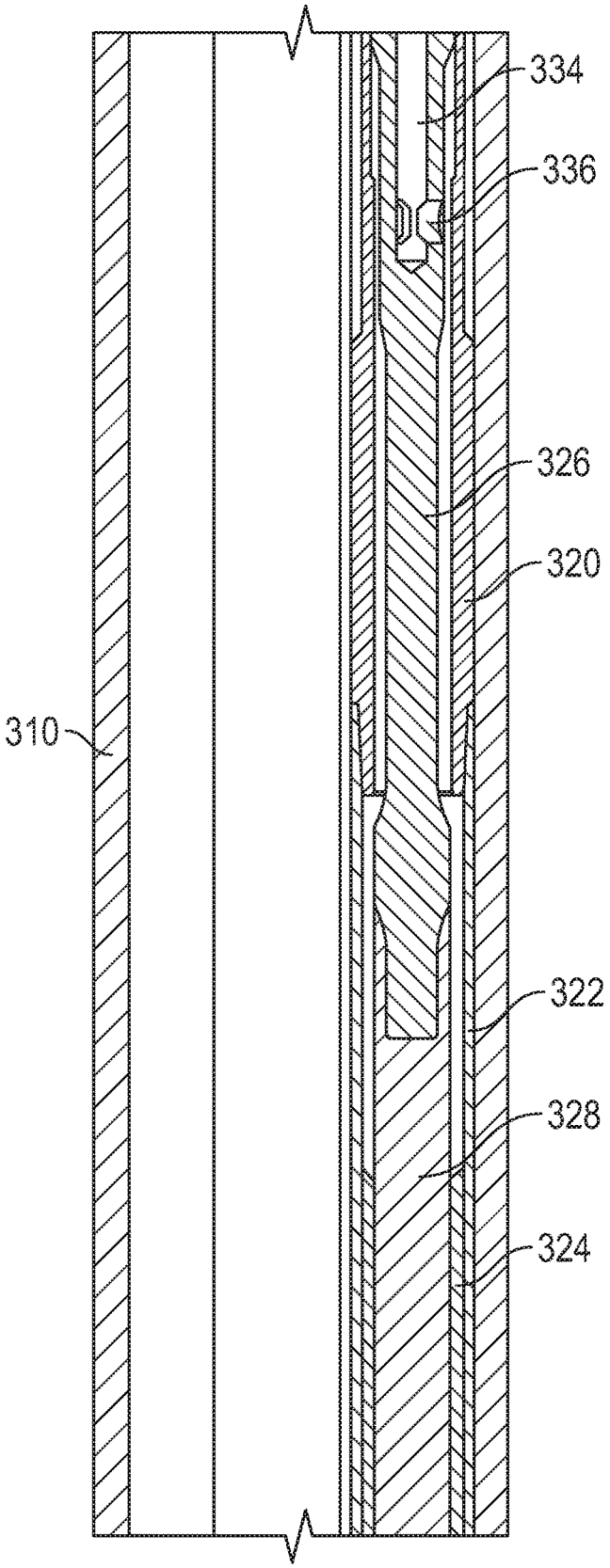
Figure 16C:
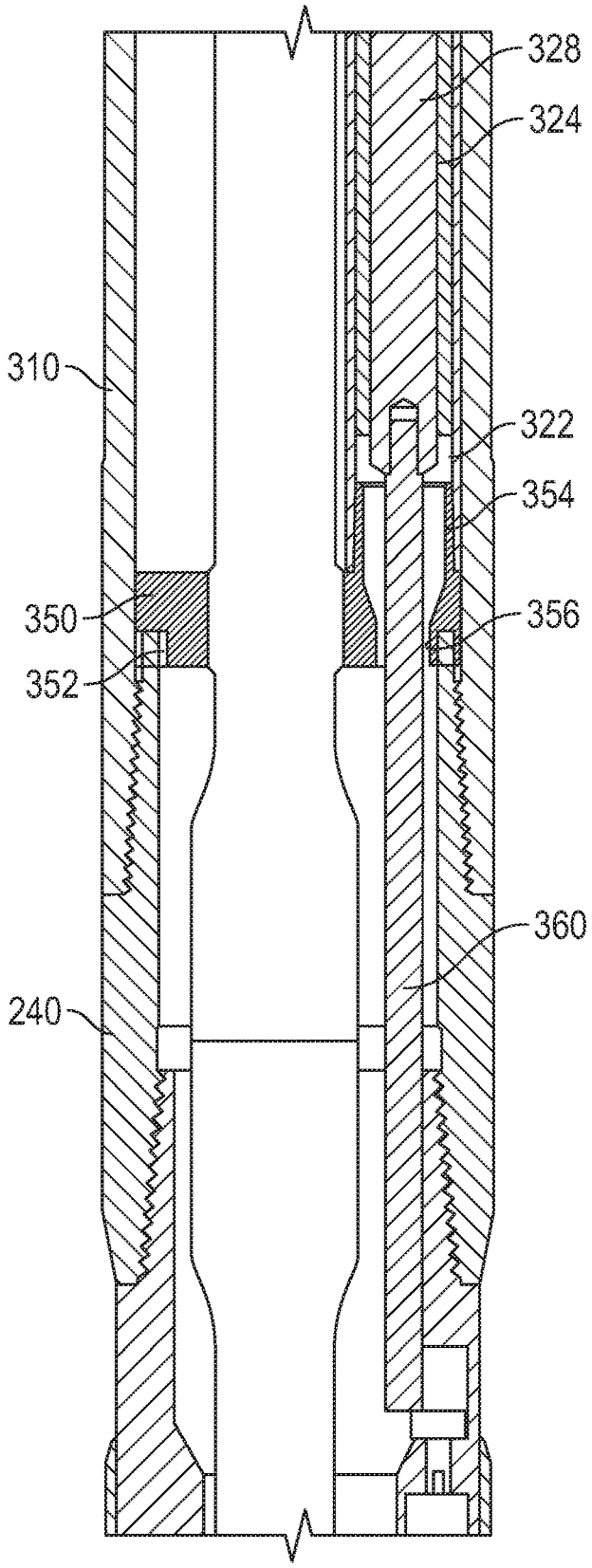

Referring now to FIGS. 16A-16C, upper orienting shaft 306 may include one or more fluid ports 330 extending from an external surface to central bore 332. Fluid ports 330 may be disposed above guide 312. Central bore 332 is aligned and in fluid communication with central bore 334 extending through lower orienting shaft 326, which is in fluid communication with one or more fluid ports 336 extending from central bore 334 to an external surface of lower orienting shaft 326. Fluid ports 336 may be disposed below a bearing section of the orienting motor.

The orienting motor's bearing section may include any combination of radial bearings and/or thrust bearings disposed between upper orienting frame 318 and upper orienting shaft 306. For example, the orienting motor may include upper radial bearings 340, thrust bearings 342, and lower radial bearings 344 disposed between upper orienting frame 318 and upper orienting shaft 306. This bearing section may allow for relative rotation between upper and lower orienting shafts 306 and 326 and orienting frames 318, 320, and 322.

A drilling fluid may flow through fluid ports 330 and central bore 332 of upper orienting shaft 306, then through central bore 334 and fluid ports 336 of lower orienting shaft 326 to bypass the orienting motor's bearing section. The drilling fluid may then flow between middle orienting frame 320 and lower orienting shaft 326, then between lower orienting frame 322 and orienting rotor 328. As readily understood by skilled artisans, the drilling fluid may then flow through the cavities formed between orienting stator 324 and orienting rotor 328 to provide the rotation in the second direction at the variable rotation rate of orienting housing 310, housing 296 of orienting crossover sub 238, swivel mandrel 272, and swivel nut 270 (shown in FIGS. 15C and 15D).

As readily understood by skilled artisans, the orienting motor may be an electric motor driven by batteries or another electric energy source.

Figure 15E:
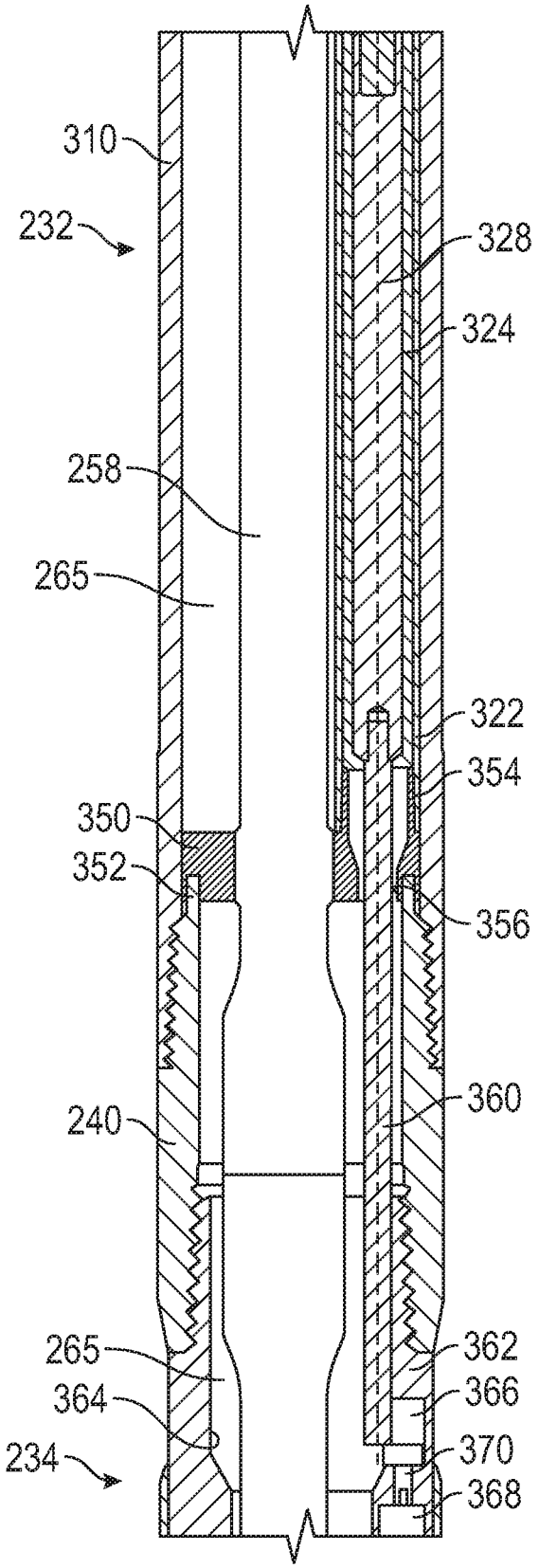

With reference to FIGS. 15E and 16C, orienting section 232 may further include lower guide 350 disposed within orienting housing 310 near its lower end. Lower guide 350 is configured to separate transmission shaft 258 from the orienting motor and to maintain the position of the orienting motor and transmission shaft 258 within orienting housing 310. Transmission shaft 258 may be disposed through an offset bore of lower guide 350. Lower guide 350 may also include lower groove 352 configured to receive an upper end of brake crossover sub 240. Lower guide 350 may further include vertical extension 354 with motor bore 356 extending through vertical extension 354 to the lower end of lower guide 350. The upper end of vertical extension 354 may be disposed within a central bore of lower orienting frame 322. In this way, fluid exiting the chambers between orienting rotor 328 and orienting stator 324 is directed through motor bore 356 of lower guide 350 to a central bore of brake crossover sub 240.

Referring still to FIGS. 15E and 16C, brake actuator 360 may be secured to a lower end of orienting rotor 328. Brake actuator 360 may extend through motor bore 356 of lower guide 350 and through brake crossover sub 240. An upper end of brake crossover sub 240 may be secured to a lower end of orienting housing 310, and a lower end of brake crossover sub 240 may be secured to an upper end of electronics housing 362 of electronics section 234. The lower end of brake actuator 360 extends at least partially into central bore 364 of electronics housing 362. Transmission shaft 258 also extends through central bore 364 of electronics housing 362. Electronics housing 362 includes one or more cavities 366 between central bore 364 and its outer surface.

Electronics section 234 may also include motor 368 electronically connected to control 370. Motor 368 and control 370 may be disposed within cavities 366. Control 370 engages a lower end of brake actuator 360 to adjust a brake torque as explained in more detail below. Control 370 may be a gear or any other control mechanism capable of engaging the lower end of brake actuator 360. Electronics section 234 may further include control unit 372 disposed within central bore 364 of electronics housing 362. Control unit 372 may include electronic components, such as one or more processors, microprocessors, CPUs, electronic storage or memory devices, batteries (e.g., commercially available batteries such as size "D" or size "C" batteries), and/or sensors (e.g., sensors for gamma, inclination, tool face, pressure, temperature, WOB, torque, and relative rotation rate). Control unit 372 includes central bore 374 dimensioned to allow transmission shaft 258 to extend therethrough. Electronic connections 376 extend from control unit 372 to motor 368. In this way, control 370 and motor 368 may be controlled by components in control unit 372. Electronic port 378 may extend from an outer surface of electronic housing 362 to electronic connections 376 to allow a user to upload data or instructions into or download data, analytics, or measurements from components within control unit 372. Electronics section 234 may further include antenna 380 disposed in an external recess of electronics housing 362. Electronic connections 382 extend from electronic connections 376 to antenna 380. In this way, antenna 380 may transmit data to a receiver sub and a MWD section above. Electronic port 384 may extend from an outer surface of electronic housing 362 to electronic connections 386 to allow a user to upload data or instructions into or download data, analytics, or measurements from components within control unit 150. Sleeve 388 may be disposed over electrical housing 362 to encase all elements of electrical section 234 that are externally exposed, such as cavities 366, antenna 380, and electrical ports 378 and 384. In this way, sleeve 388 protects the elements of electrical section 234. In one embodiment, sleeve 388 may be a short hop transmitter configured to send electromagnetic signals to a short hop receiver sub in a MWD section above. The electromagnetic signals may include information about inclination, gamma, and tool face. Electrical housing 362 and control unit 372 rotate with brake crossover sub 240, orienting housing 310, housing 296 of orienting crossover sub 238, swivel mandrel 272, and swivel nut 270 in the second direction at the variable rotation rate in relation to swivel base 264. Transmission shaft 258 rotates within central bore 364 of electrical housing 362 and within central bore 374 of control unit 372 in the first direction at the rotor rotation rate plus the drill string rotation rate.

Figure 15F:
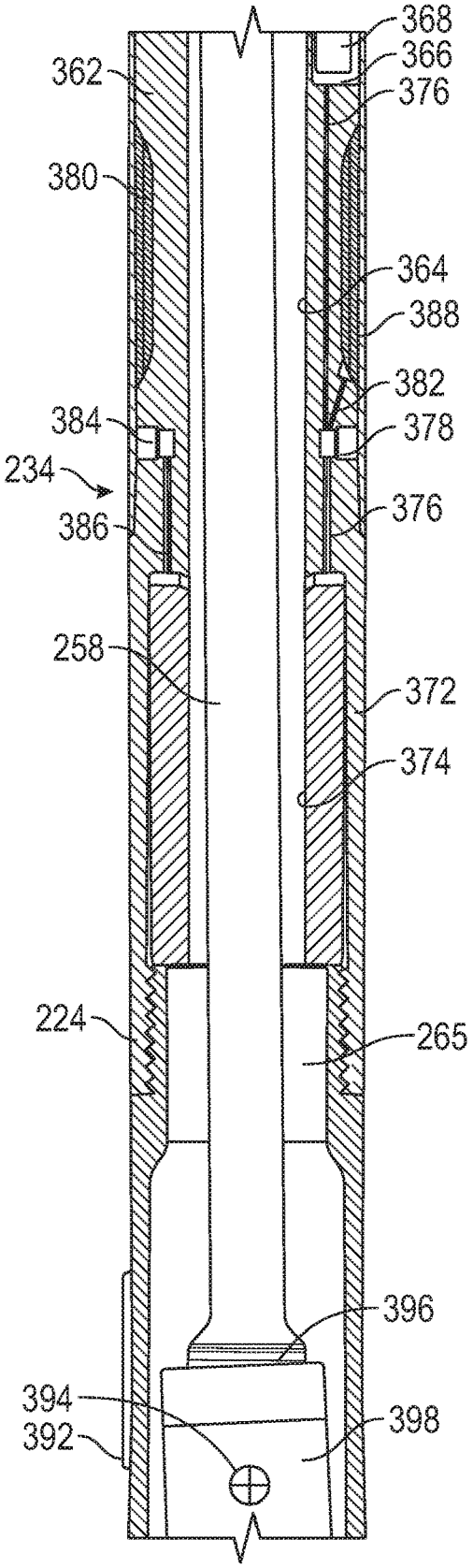

With reference to FIGS. 14 and 15F, a lower end of electronics housing 362 is secured to bent housing 224. An axis of the lower end of bent housing 224 is offset from an axis of the upper end of bent housing 224 to deviate drill bit 228 by a predetermined angle. Wear surface 392 is secured to an outer surface of bent housing 224 over bend point 394 of bent housing 224. A lower end of bent housing 224 is secured to bearing section 226. Lower shaft end 396 of transmission shaft 258 connects to a bearing mandrel through link 398. Link 398 may be a continuous velocity joint (i.e., C-V joint), flex shaft, or any other connection configured to transfer sufficient torque between transmission shaft 258 and the bearing mandrel. Bent housing 224 rotates with swivel mandrel 372 and electrical housing 362 in the second direction at the variable rotation rate. Transmission shaft 258 and the bearing mandrel rotate in the first direction at the rotor rotation rate plus the drill string rotation rate. The bearing mandrel in turn rotates drill bit 228 in the first direction at the rotor rotation rate plus the drill string rotation rate. Bearing section 226 may include any combination of radial bearings and thrust bearings to transmit weight on bit from the drill string above and to transmit torque and rotation from power section 222 to drill bit 228. Radial bearings in bearing section 226 absorbs side loading from drill bit 228. Bearing section 226 allows for the relative rotation between drill bit components (i.e, the bearing mandrel and drill bit 228) and lower end components (i.e., a housing of bearing section 226, bent housing 224, electronics section 234, brake crossover sub 240, orienting housing 310, housing 296 of orienting crossover sub 238, swivel mandrel 272, and swivel nut 270). In this way, swivel 230 allows the lower end of drilling assembly 220 to rotate independently from the remainder of drilling assembly 220 and the drill pipe above while transmitting weight on bit and overpull forces.

Drilling assembly 220 may be used in the same manner as described above in connection with drilling assembly 10. Specifically, an upper portion of drilling assembly 220 may rotate with a drill string above in a first direction at a drill string rotation rate, the orienting section may cause a lower portion of drilling assembly 220 to rotate in a second direction at a variable rotation rate, and a rotor from a power section in the upper portion of drilling assembly 220 is secured to a transmission shaft extending from the power section through the orienting section and all other components to the drill bit. Except as otherwise described or illustrated, drilling assembly 220 and its components have the same features and operate in the same way as drilling assembly 10 (e.g., relative rotations among upper portion, lower portion, and drill bit in rotary mode and sliding mode).

Except as otherwise described or illustrated, each of the components in this assembly has a generally cylindrical shape and may be formed of steel, another metal, or any other durable material. Each assembly described in this disclosure may include any combination of the described components, features, and/or functions of each of the individual assembly embodiments. Each method described in this disclosure may include any combination of the described steps in any order, including the absence of certain described steps and combinations of steps used in separate embodiments. Any range of numeric values disclosed herein includes any subrange therein. Plurality means two or more.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. A bore hole drilling assembly comprising:

a power section including a power section housing and a power section output, wherein the power section housing is configured for connection below a drill string, wherein the power section housing rotates in a first direction at a first rotation rate relative to a wellbore in response to a rotation of the drill string, and wherein the power section output rotates in the first direction at a second rotation rate relative to the power section housing in response to a fluid flow through the power section;

a drill bit operatively connected to the power section output through a transmission shaft for rotation of the drill bit in the first direction;

a bent housing disposed between the power section and the drill bit, wherein the transmission shaft extends through the bent housing, wherein the bent housing is configured for rotation in a second direction at a variable rotation rate relative to the power section housing, wherein the second direction is opposite the first direction;

a mechanical brake system configured to apply no load or apply a plurality of loads to adjust the variable rotation rate of the bent housing;

an electronics section configured to automatically adjust the load applied by the mechanical brake system to adjust a differential rate of rotation between the power section and the bent housing;

wherein the electronics section is configured to automatically adjust the mechanical brake system to select a mode of the drilling assembly in response to a value of the first rotation rate, wherein in a rotary mode the bent housing rotates relative to the wellbore, wherein in a sliding mode the electronics section adjusts the load applied by the mechanical brake system to set the rotation rate of the bent housing in the second direction to a value that is equal to the first rotation rate of the power section in the first direction such that the bent housing does not rotate relative to the wellbore, and wherein in all modes, a rotation rate of the drill bit in the first direction relative to the wellbore is the sum of the first rotation rate of the power section housing and the second rotation rate of the power section output relative to the power section housing.

2. The bore hole drilling assembly of claim 1, wherein the power section includes a stator secured within the power section housing for rotation with the power section housing, wherein the power section output is a rotor disposed within and engaging the stator for rotation of the rotor in the first direction at the second rotation rate relative to the stator in response to the fluid flow through the power section, wherein the rotor is connected to the transmission shaft for rotation of the drill bit relative to the power section housing, wherein in all modes the rotation rate of the drill bit in the first direction relative to the wellbore is the sum of the first rotation rate of the power section housing and the second rotation rate of the rotor of the power section relative to the power section housing.

3. The bore hole drilling assembly of claim 1, wherein the electronics section is also configured to automatically adjust the mechanical brake system to adjust a tool face orientation of the drill bit.

4. The bore hole drilling assembly of claim 3, wherein the electronics section adjusts the mechanical brake system to incrementally adjust the tool face orientation of the drill bit.

5. The bore hole drilling assembly of claim 1 configured so that application of no load by the mechanical brake system results in a differential rotation rate between the power section and the bent housing.

6. A bore hole drilling assembly comprising:

a power section including a power section housing and a power section output, wherein the power section housing is configured for connection below a drill string, wherein the power section housing rotates in a first direction at a first rotation rate relative to a wellbore in response to a rotation of the drill string, and wherein the power section output rotates in the first direction at a second rotation rate relative to the power section housing in response to a fluid flow through the power section;

a drill bit operatively connected to the power section output through a transmission shaft for rotation of the drill bit in the first direction;

an orienting section operatively connected between the power section and the drill bit, wherein the orienting section includes an orienting stator secured within an orienting housing and an orienting rotor disposed within and engaging the orienting stator, wherein a bypass central bore extends through the orienting rotor, wherein the transmission shaft extends through the bypass central bore of the orienting rotor, wherein the orienting housing rotates in the first direction at the first rotation rate with the power section housing, wherein the orienting rotor rotates in a second direction at a variable rotation rate relative to the orienting housing, and wherein the second direction is opposite the first direction;

a bent housing operatively connected between the orienting section and the drill bit with the transmission shaft extending through the bent housing, wherein the bent housing is operatively connected to the orienting rotor such that the bent housing rotates in the second direction at the variable rotation rate relative to the orienting housing;

a mechanical brake system configured to adjust the variable rotation rate of the orienting rotor and the bent housing;

an electronics section configured to automatically adjust the mechanical brake system to select a mode of the drilling assembly in response to a value of the first rotation rate, wherein in a rotary mode the bent housing rotates relative to the wellbore, wherein in a sliding mode the bent housing does not rotate relative to the wellbore to maintain a direction and an inclination of the drill bit while the power section housing and the orienting housing rotate in the first direction; and wherein in all modes a rotation rate of the drill bit in the first direction relative to the wellbore is the sum of the first rotation rate of the power section housing and the second rotation rate of the power section output relative to the power section housing.

7. The bore hole drilling assembly of claim 6, further comprising a swivel section including one or more bearings, wherein the mechanical brake system is disposed in the swivel section.

8. The bore hole drilling assembly of claim 7, wherein the swivel section further includes a swivel housing and a swivel mandrel, wherein the swivel housing is operatively connected to the orienting housing such that the swivel housing rotates in the first direction at the first rotation rate with the orienting housing, and wherein the swivel mandrel is operatively connected between the orienting rotor and the bent housing such that the swivel mandrel rotates in the second direction at the variable rotation rate relative to the orienting housing.

9. The bore hole drilling assembly of claim 8, wherein the one or more bearings are configured to support the relative rotation between the swivel housing and the swivel mandrel, and wherein the one or more bearings comprise at least one radial bearing and at least one thrust bearing.

10. The bore hole drilling assembly of claim 8, wherein the mechanical brake system includes a drum brake assembly, a cone brake assembly, or a clutch assembly.

11. The bore hole drilling assembly of claim 8, wherein the mechanical brake system includes a drum brake assembly having a brake actuator disposed within the swivel mandrel and around the transmission shaft, wherein the drum brake assembly also includes a brake pad and a spring-loaded brake shoe, wherein the spring-loaded brake shoe extends radially through an opening in the swivel mandrel such that a proximal end of the spring-loaded brake shoe engages an outer surface of the brake actuator and a distal end of the spring-loaded brake shoe is secured to the brake pad.

12. The bore hole drilling assembly of claim 11, wherein the drum brake assembly is activated by rotating the brake actuator to displace the spring-loaded brake shoe radially outward to increase a brake torque between the swivel mandrel and the swivel housing.

13. The bore hole drilling assembly of claim 11, wherein the drum brake assembly is activated by axial movement of the brake actuator to displace the spring-loaded brake shoe radially outward to increase a brake torque between the swivel mandrel and the swivel housing.

14. The bore hole drilling assembly of claim 8, wherein the swivel housing includes a swivel bearing housing and a swivel nut, wherein the one or more bearings are disposed within the swivel bearing housing, and wherein the brake system engages the swivel nut.

15. The bore hole drilling assembly of claim 7, further comprising a crossover sub disposed between the power section and the orienting section, wherein the crossover sub is connected to the power section housing and the orienting housing for rotation of the crossover sub in the first direction at the first rotation rate with the power section housing and the orienting housing, wherein the transmission shaft is disposed through the power crossover sub.

16. The bore hole drilling assembly of claim 15, further comprising a second crossover sub disposed between the orienting section and the swivel section, the second crossover sub including a second crossover housing and a flexible shaft, wherein the second crossover housing is connected to the orienting housing and the swivel housing such that the second crossover housing rotates in the first direction at the first rotation rate with the orienting housing and the swivel housing, wherein the flexible shaft is connected between the orienting rotor and the swivel mandrel such that the flexible shaft rotates in the second direction at the variable rotation rate with the orienting rotor and the swivel mandrel, wherein the flexible shaft includes one or more bypass openings configured to allow fluid to flow into the central bore from outside the flexible shaft, and wherein the transmission shaft is disposed through a central bore of the flexible shaft.

17. The bore hole drilling assembly of claim 7, wherein the electronics section includes an electronics housing, one or more sensors, a short hop transmitter, a power source, a memory device, and a processor, wherein the electronics housing is connected to the swivel mandrel and the bent housing such that the electronics housing rotates in the second direction at the variable rotation rate with the swivel mandrel and the bent housing, and wherein the transmission shaft is disposed through the electronics housing.

18. The bore hole drilling assembly of claim 17, wherein the power source includes batteries.

19. The bore hole drilling assembly of claim 17, wherein the one or more sensors include a differential rotation sensor configured to detect a differential rotation rate between the swivel mandrel and the power section housing, and wherein the one or more sensors further include a gamma sensor, an inclination sensor, a tool face sensor, a pressure sensor, a temperature sensor, a weight-on-bit sensor, or a torque sensor.

20. The bore hole drilling assembly of claim 17, wherein the short hop transmitter is configured to send electromagnetic signals to a receiver in a measurement-while-drilling sub above the power section.

21. The bore hole drilling assembly of claim 17, wherein the electronics section further includes a gear for activating the brake actuator, wherein the gear is powered by a motor that is connected to the processor in the electronics section.

22. A bore hole drilling assembly comprising:

a power section including a power section housing and a power section output, wherein the power section housing is configured for connection below a drill string, wherein the power section housing rotates in a first direction at a first rotation rate relative to a wellbore in response to a rotation of the drill string, and wherein the power section output rotates in the first direction at a second rotation rate relative to the power section housing in response to a fluid flow through the power section;

a drill bit operatively connected to the power section output through a transmission shaft for rotation of the drill bit in the first direction;

an orienting section operatively connected between the power section and the drill bit, wherein the orienting section includes an orienting housing having a central bore and an orienting motor disposed in the central bore, wherein the transmission shaft extends through the central bore of the orienting housing, wherein the orienting motor rotates the orienting housing in a second direction at a variable rotation rate relative to the power section housing, and wherein the second direction is opposite the first direction;

a bent housing operatively connected between the orienting section and the drill bit with the transmission shaft extending through the bent housing, wherein the bent housing is operatively connected to the orienting housing such that the bent housing rotates in the second direction at the variable rotation rate relative to the power section housing;

a mechanical brake system configured to adjust the variable rotation rate of the orienting housing and the bent housing;

an electronics section configured to automatically adjust the mechanical brake system to select a mode of the drilling assembly in response to a value of the first rotation rate, wherein in a rotary mode the bent housing rotates relative to the wellbore, wherein in a sliding mode the bent housing does not rotate relative to the wellbore to maintain a direction and an inclination of the drill bit while the power section housing rotates in the first direction; and wherein in all modes a rotation rate of the drill bit in the first direction relative to the wellbore is the sum of the first rotation rate of the power section housing and the second rotation rate of the power section output relative to the power section housing.

23. The bore hole drilling assembly of claim 22, further comprising a swivel section operatively connected between the power section and the orienting section, wherein the swivel section includes one or more bearings.

24. The bore hole drilling assembly of claim 23, wherein the swivel section further includes a swivel base and a swivel mandrel disposed around a lower portion of the swivel base, wherein the swivel base is operatively connected to the power section housing such that the swivel base rotates in the first direction at the first rotation rate with the power section housing, and wherein the swivel mandrel is operatively connected above the orienting housing such that the swivel mandrel rotates in the second direction at the variable rotation rate relative to the power section housing.

25. The bore hole drilling assembly of claim 24, wherein the one or more bearings are disposed between the swivel mandrel and the swivel base to support the relative rotation between the swivel mandrel and the swivel base, wherein the one or more bearings comprises at least one radial bearing and at least one thrust bearing, and wherein the swivel mandrel includes a swivel bearing mandrel and a swivel nut.

26. The bore hole drilling assembly of claim 22, wherein the mechanical brake system includes a brake actuator connected to a lower end of the orienting motor.

* * * * *